US008613642B2

(12) United States Patent
Bowles et al.

(10) Patent No.: US 8,613,642 B2
(45) Date of Patent: Dec. 24, 2013

(54) PREPARATION TOOLS FOR PIPE ENDS AND RELATED METHODS

(75) Inventors: Richard R. Bowles, Solon, OH (US); Paul W. Gress, Bay Village, OH (US); Brian A. Mitchell, North Olmsted, OH (US); Robert M. Baracskai, North Ridgeville, OH (US)

(73) Assignee: Emerson Electric Co., St. Louis, MO (US)

( * ) Notice: Subject to any disclaimer, the term of this patent is extended or adjusted under 35 U.S.C. 154(b) by 445 days.

(21) Appl. No.: 12/857,826

(22) Filed: Aug. 17, 2010

(65) Prior Publication Data

US 2011/0045746 A1 Feb. 24, 2011

Related U.S. Application Data

(60) Provisional application No. 61/234,781, filed on Aug. 18, 2009, provisional application No. 61/312,697, filed on Mar. 11, 2010.

(51) Int. Cl.
*B24B 33/04* (2006.01)
*B24B 33/00* (2006.01)

(52) U.S. Cl.
USPC ..... 451/51; 451/358; 15/104.04

(58) Field of Classification Search
CPC ..... B24B 33/04; B24B 33/00
USPC ..... 451/51, 344, 358, 359, 65, 439, 462, 451/464; 15/104.03, 104.04
See application file for complete search history.

(56) References Cited

U.S. PATENT DOCUMENTS

| | | | | | |
|---|---|---|---|---|---|
| 1,312,333 | A | * | 8/1919 | Lebow | 72/119 |
| 2,002,317 | A | * | 5/1935 | Hoke | 451/49 |
| 2,645,000 | A | * | 7/1953 | Finch | 29/57 |
| 2,843,918 | A | * | 7/1958 | Koppelmann | 29/90.01 |
| 3,188,674 | A | | 6/1965 | Hobbs | |
| 3,795,956 | A | * | 3/1974 | Kalen | 29/90.01 |
| 4,246,728 | A | * | 1/1981 | Leasher | 451/439 |
| 4,433,448 | A | | 2/1984 | True | |
| 4,467,489 | A | | 8/1984 | Begneaud | |
| 4,468,829 | A | | 9/1984 | Christensen | |
| 4,693,105 | A | * | 9/1987 | Lee, Jr. | 72/84 |
| 4,862,549 | A | * | 9/1989 | Criswell et al. | 15/104.04 |
| 4,955,165 | A | * | 9/1990 | Brooks et al. | 451/464 |
| 5,038,525 | A | * | 8/1991 | Gardner | 451/439 |
| 5,074,913 | A | | 12/1991 | Trivett | |
| 5,106,415 | A | | 4/1992 | Davidian | |

(Continued)

FOREIGN PATENT DOCUMENTS

CH 664099 A5 * 2/1988

OTHER PUBLICATIONS

International Preliminary Report on Patentability, dated Mar. 1, 2012.

*Primary Examiner* — Joseph J Hail
*Assistant Examiner* — Marc Carlson
(74) *Attorney, Agent, or Firm* — Mark E. Bandy; Rankin, Hill & Clark LLP

(57) ABSTRACT

Various systems, tools, and methods are described for rendering regions of coated pipe suitable for receiving press fittings. The systems, tools, and methods may also be applicable for transforming regions of pipe, coated or uncoated, and which are otherwise unsuitable for sealingly engaging press fittings, so that reliable and leak-proof seals can be made between the pipe and press fittings.

34 Claims, 35 Drawing Sheets

(56) References Cited

U.S. PATENT DOCUMENTS

| | | | | |
|---|---|---|---|---|
| 5,348,575 | A | 9/1994 | Muller et al. | |
| 5,419,087 | A * | 5/1995 | Haddy | 451/344 |
| 5,791,005 | A * | 8/1998 | Grabowski et al. | 15/104.04 |
| 6,101,696 | A * | 8/2000 | Carter | 29/90.01 |
| 6,106,370 | A * | 8/2000 | Carter | 451/51 |
| 6,299,518 | B1 * | 10/2001 | Daggett | 451/344 |
| 6,393,645 | B1 * | 5/2002 | Kadinger | 15/104.04 |
| 6,497,022 | B1 * | 12/2002 | Carter | 29/90.01 |
| 6,553,601 | B1 * | 4/2003 | Major | 15/104.04 |
| 6,561,888 | B2 | 5/2003 | Domanski et al. | |
| 6,666,062 | B2 * | 12/2003 | Dole et al. | 72/121 |
| 6,698,048 | B1 * | 3/2004 | Greene | 7/158 |
| 6,769,151 | B1 * | 8/2004 | Lin | 15/104.04 |
| 6,813,797 | B1 * | 11/2004 | Kadinger | 15/104.04 |
| 6,918,278 | B2 * | 7/2005 | Dole et al. | 72/123 |
| 6,961,974 | B1 * | 11/2005 | Goolsby, Jr. | 15/104.04 |
| 6,964,077 | B2 * | 11/2005 | Kadinger et al. | 15/104.03 |
| 6,968,719 | B2 * | 11/2005 | Zifferer | 72/96 |
| 7,124,882 | B1 * | 10/2006 | Jadydy | 206/234 |
| 7,263,737 | B1 * | 9/2007 | Walsh et al. | 15/104.04 |
| 7,361,079 | B2 * | 4/2008 | Pryce et al. | 451/344 |
| D598,173 | S * | 8/2009 | Hartel | D32/40 |
| 7,607,187 | B2 * | 10/2009 | Vargas | 15/104.03 |
| 8,032,970 | B2 * | 10/2011 | Chen | 15/160 |
| 2003/0172481 | A1 * | 9/2003 | Yehia | 15/104.04 |
| 2004/0116057 | A1 * | 6/2004 | Dinsdale | 451/462 |
| 2004/0142648 | A1 * | 7/2004 | Laws | 451/523 |
| 2004/0200018 | A1 * | 10/2004 | Kadinger et al. | 15/104.04 |
| 2004/0255414 | A1 * | 12/2004 | Tulipana | 15/104.04 |
| 2007/0197153 | A1 * | 8/2007 | Pryce et al. | 451/523 |
| 2010/0122423 | A1 * | 5/2010 | Lozar | 15/104.04 |

* cited by examiner

PREPARATION TOOLS FOR PIPE ENDS AND RELATED METHODS

CROSS REFERENCES TO RELATED APPLICATIONS

This application claims priority upon U.S. patent application Ser. No. 61/312,697 filed on Mar. 11, 2010; and Ser. No. 61/234,781 filed on Aug. 18, 2009.

FIELD OF INVENTION

The present invention relates to tools, tool systems, and related methods for transforming ends of pipe, to render the pipe end suitable for receiving a fitting. The present invention is particularly directed to a portable tool for preparing pipe ends.

BACKGROUND OF THE INVENTION

Many types of pipe are unsuitable for receiving press type fittings. One such type of pipe is steel piping typically used in plumbing and pressure applications, and typically referred to as "black pipe." Black pipe is a carbon steel pipe that typically contains a black-colored coating along its outer surface. Black pipe is specified in ASTM A53.

Black pipe is typically unsuitable for press fittings because its outer surface is characterized by various surface defects including axial scratches, jaw marks, "zipper line" defects often resulting during manufacture and processing of the pipe, and rough and inconsistent surface properties associated with the black coating. These and other surface irregularities create difficulties in establishing a reliable and effective seal between the pipe and a fitting pressed thereon. Also, black pipe manufactured and sold in the US typically exhibits a relatively large deviation with respect to its outer diameter. All of these factors have hindered the development of practical and effective strategies for preparing pipe ends for receiving press fittings for coated pipe, and particularly for black pipe.

Furthermore, there are various common processes used to cut steel pipe such as abrasive cut off saws, carbide tipped saws, fine toothed reciprocating saws or portable band saws or displacement wheel pipe cutters for example. Each of these methods results in burrs on the pipe end after cutting which could cut seals upon insertion into a press type fitting. Accordingly, a significant need exists for tools, tool systems, and methods for preparing the ends of pipe.

SUMMARY OF THE INVENTION

The difficulties and drawbacks associated with previous systems, methods and practices are addressed in the present invention for certain tools, systems, and techniques for preparing pipe ends or end regions in such a manner that the pipe can then be used with a press fitting.

The present invention relates to various tools, systems, and methods for conveniently and effectively preparing the end regions of pipe or other workpieces so that the regions can then accept and sealingly engage press fittings. The invention is particularly directed to preparing the ends of coated steel pipe such as black pipe, however is not limited to such applications.

The present invention provides tools, systems, and methods with respect to a portable device to perform these pipe end preparations. It is contemplated that the invention is also applicable to tools, systems, and methods regarding a stationary, yet movable, device to perform the noted pipe end preparations.

In one aspect, the present invention provides a workpiece end preparation tool comprising a housing having a front face, a rear plate, and a sidewall extending therebetween. The housing defines a generally hollow interior accessible from a workpiece opening defined in the front face. The tool also comprises a front plate disposed within the hollow interior of the housing. The front plate is affixed to the housing. The front plate defines a forward face, an oppositely directed rear face, and a centrally disposed aperture extending between the forward and the rear faces. The tool also comprises an abrasive assembly disposed within the hollow interior of the housing and releasably affixed thereto. The abrasive assembly defines at least one abrasive surface exposed within the hollow interior of the housing. The tool also comprises a plurality of rollers disposed within the hollow interior of the housing. Each roller is mounted to the housing and oriented at an angle of from about 10° to about 30° with respect to a longitudinal axis of the housing.

In another aspect, the invention provides a workpiece end preparation tool comprising a generally cylindrical housing defining a longitudinal axis, an open front face, a rear wall, and a circumferential wall extending therebetween. The circumferential wall defines an inner circumferential face. The inner circumferential face and the rear wall collectively define a hollow interior accessible from the open front face. The tool also comprises an abrasive assembly disposed within the hollow interior of the housing. The abrasive assembly includes an abrasive member extending along the inner circumferential face of the circumferential wall. The abrasive member is equidistantly spaced from the rear wall. The abrasive member includes abrasive particulate material dispersed in a substrate secured to a scrim backing. The tool also comprises a shaft extending rearwardly from the rear wall of the housing. The shaft extends collinearly with the longitudinal axis of the housing.

In a further aspect, the invention provides a workpiece end preparation tool comprising a housing having a front face, a rear plate, and a sidewall extending therebetween. The housing defines a generally hollow interior accessible from a workpiece opening defined in the front face. The tool also comprises a front plate disposed within the hollow interior of the housing. The front plate is affixed to the housing. The front plate defines a forward face, an oppositely directed rear face, and a centrally disposed aperture extending between the forward and the rear faces. And, the tool comprises a plurality of rollers disposed within the hollow interior of the housing, each roller mounted with the housing and oriented at an angle of from about 10° to about 30° with respect to a longitudinal axis of the housing.

In still another aspect, the invention provides a method for preparing an end of a workpiece to expose a fresh outer surface region along an end of the workpiece. The method comprises providing a tool including a cylindrical housing defining a longitudinal axis, an open front face, a rear wall, and a circumferential wall extending therebetween. The housing defines a hollow interior accessible from the front face. The tool further includes an abrasive assembly disposed within the hollow interior of the housing. The abrasive assembly defines an abrasive surface extending along the inner circumferential face of the circumferential wall. The method also comprises inserting an end of a workpiece through the open front face of the housing and into the hollow interior of the housing until the end contacts the rear wall of the housing. The method further comprises contacting an outer surface of the workpiece with a portion of the abrasive surface while maintaining contact between the workpiece end and the rear wall of the housing. And, the method additionally comprises displacing the tool relative to the workpiece to thereby expose a fresh outer surface along an outer region of the workpiece as a result of contact between the outer surface of the workpiece and the abrasive surface. Preferably, displacement of the tool is performed by rotating the tool about the longitudinal axis of the housing.

Furthermore, in still another aspect, the invention provides a method for preparing a workpiece end. The method comprises providing a tool including a housing defining a generally hollow interior accessible from a workpiece opening defined in a front face of the housing, a front plate disposed within the housing, the front plate defining a forward face and a centrally disposed aperture, an abrasive assembly disposed within the housing, and a plurality of rollers disposed within the housing. The method also comprises inserting an end of a workpiece to be prepared in the hollow interior of the tool. And, the method comprises displacing at least one of the tool and the workpiece while contacting the workpiece with the tool, to thereby modify the workpiece end.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Figure 1:
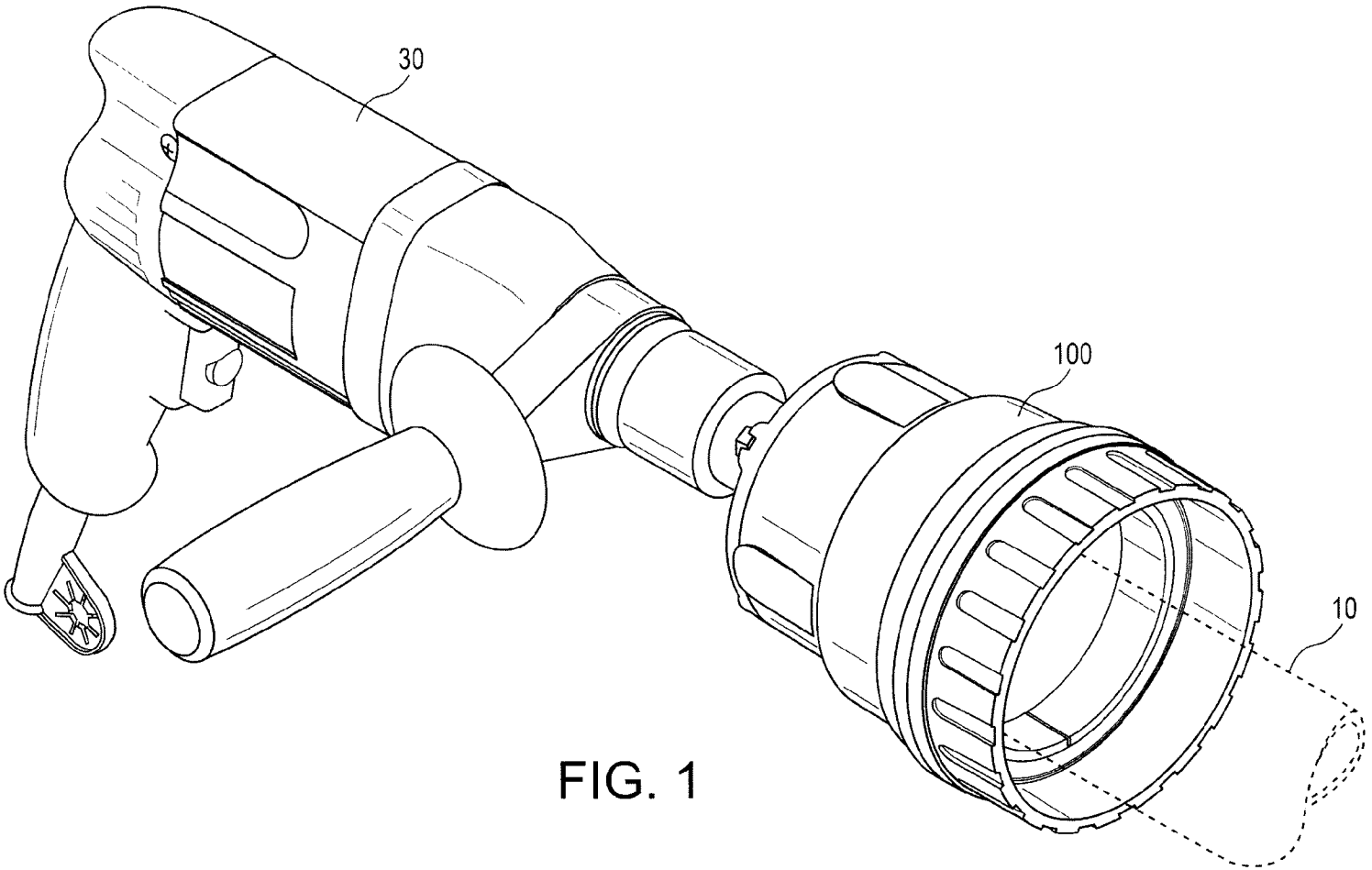
FIG. 1 is a perspective view of a preferred embodiment tool in accordance with the invention illustrating its use with a drill and a pipe.

In accordance with the present invention, various tools, systems and related methods are provided for conveniently and effectively transforming an end region of a pipe, such as for example black pipe, such that the region can receive and accept a press fitting subsequently engaged thereto. The various systems and related methods can be efficiently performed in the field, and can be used in new piping applications or in the repair or retrofitting of existing piping systems.

Generally, the invention provides tools that perform one or more of the following operations: (i) removing an effective amount of a coating such as for example black coating, from an exterior region of the pipe, and (ii) removing any burrs or outwardly extending projections from the end region of the pipe. The invention accomplishes each of these operations (i)-(ii) in a variety of different manners. Although the present invention is primarily described herein with regard to preparing black pipe for press sealing applications, it will be understood that application of the invention is not limited to black pipe. Generally, any pipe having a coating and/or an exterior surface that renders press fit sealing impractical or impossible, is a candidate for the present invention. The term "black pipe" as used herein refers to ungalvanized steel pipe, which typically contains a black colored coating. Furthermore, although the invention is primarily described in regards to preparing pipe ends or end regions, it will be appreciated that the invention is not limited to pipes. Instead, nearly any type of workpiece can be prepared or otherwise modified using the various tools, systems, and methods described herein. Moreover, it will also be understood that the invention is not limited to preparing pipes for press sealing applications, or for receiving such fittings. Instead, the invention and its various embodiments are expected to be useful in a wide array of other applications and in association with other types of fittings and hardware.

Another feature of the present invention is the ability of many of the preferred embodiment systems and tools to perform the operations (i)-(ii) concurrently or immediately after one another. This results in significant time and cost savings. It is also contemplated that one or both of operations (i)-(ii) could be combined with another operation and potentially in further combination with a cutting or severing application.

Before turning attention to the preferred embodiment systems and methods of the present invention, it is instructive to review the types of pipe coatings targeted for removal by the present invention.

Pipe Coatings

A wide array of coatings and coating systems are typically applied to pipes, and particularly to the exterior surface of pipes. As previously noted, the existence of a coating on a pipe exterior typically precludes or at least interferes with affixing and sealingly engaging a press fitting onto the coated pipe.

Various types of protective coatings have been applied to pipes in the past to resist corrosion. Initially, the protective coatings consisted of grease or oil but coatings of this type are of limited effectiveness. Subsequently, solvent-type coatings were employed in which a coating material was dissolved in an organic solvent. After application of the coating solution to the article, the solvent or carrier is evaporated to provide a firm and relatively non-greasy coating. Water-base coatings have also been employed. Thermosetting polymeric resin coatings have also been utilized as protective coatings. Hot melt dips have also been employed to provide protective coatings on ferrous articles. A further type of coating as used in the past is a sprayable hot melt coating. Generally, exterior coating types include alkyds, epoxies, zinc-rich, elastomeric urethanes as well as other multi-coat systems. Plastic can be used to coat steel pipes and thus minimize the potential for corrosion of steel pipes. A typical plastic coating system typically consists of three layers: fusion bonded epoxy (FBE) on the surface of the steel pipe, adhesive, and a top coat made from polyethylene or polypropylene. Additional details and background information of pipe coatings materials are provided in U.S. Pat. Nos. 5,074,913; 5,106,415; and 5,348,575.

The black coating on black pipe is typically a coating composition that is applied to the outer diameter of piping. One known composition is available from the Valspar Corporation under product designation WLA0133, which according to its Material Safety Data Sheet, is a black waterborne coating. The WLA0133 is designated as a paint product, containing a proprietary resin, carbon black to provide the desired black coloring, and various solvents and modifying agents. Another black coating is available from Mahoning Paint Corp. of Youngstown, Ohio, under the designation L-4042-E, LF Clear High Solids Pipe Coating. That coating contains a resin dispersed in a hydrocarbon solvent and various mineral spirits. After application of one or more suitable black coatings and at least partial drying of the coating, a clear top coat is typically applied onto the black coating.

Typically, pipe coatings have a total thickness of from about 0.001 inches to about 0.010 inches. However, the present invention can be used to remove coatings having thicknesses greater than or lesser than these thicknesses.

Preferred Embodiment Systems, Tools, and Methods

In accordance with the present invention, various preferred systems, namely tool systems, have been developed for suitably preparing piping ends for subsequent press fittings. The term "press fittings" as used herein refers to any type of fitting that is engaged about the outside diameter, typically along an end or end region of a pipe, and which can be sealingly engaged to the pipe by application of a radial compressive force about the fitting. Typically, the compressive force is applied about a fitting located at a desired location and position relative to the pipe end. The compressive force deforms the fitting and typically one or more sealing elements or other components of the fitting to sealingly engage the fitting to the pipe end. The compressive force can be applied by a variety of tools and techniques. However, a preferred technique is by use of a hydraulically operated, electrically powered press tool such as for example the RIDGID® RP 330-B, RP 330-C, or RP 210-B Press Tools, in combination with specially designed press jaws.

In accordance with the present invention, various versions of a tool have been developed that readily and effectively remove the outer coating and prepare a pipe surface for receiving a fitting. Many of these tools also include provisions for quickly and easily removing burrs or other metallic or unwanted particulates from the end regions of a pipe. The various preferred embodiment tools are all portable, lightweight, and convenient to use.

As is known in the art, pipe ends typically contain burrs which are very difficult to remove. If these burrs are not removed or re-formed to remove sharp edges, the burrs can damage O-ring seals in press type fittings when the fittings are inserted onto the pipe end. Burrs can result from dry cutting using a carbide tipped blade chop saw. Burrs can also result from cutting with an abrasive cutoff saw. However, it will be appreciated that any cutting method can produce burrs of varying degrees. The term "burr" or "burrs" as used herein is not limited to unwanted material projections along a pipe end caused from cutting. Instead the term broadly refers to any material fragment or outwardly extending region proximate a pipe end.

Figure 2:
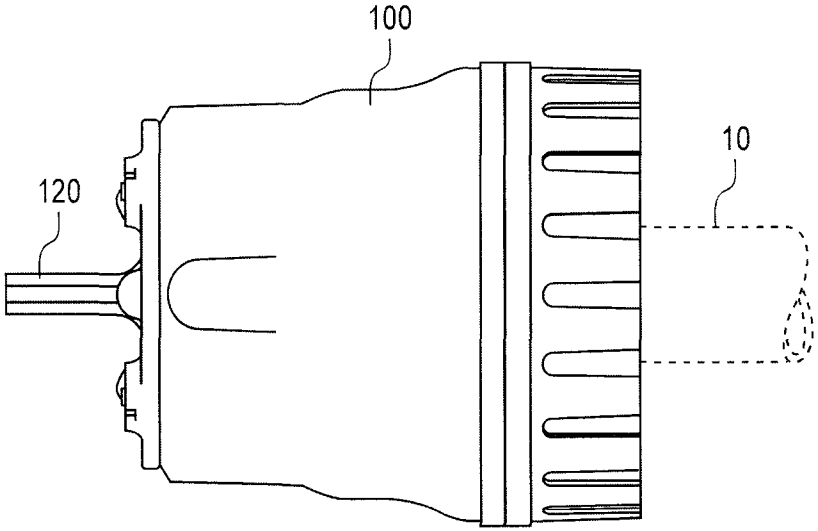
FIG. 2 is a side elevational view of the tool and pipe shown in FIG. 1.
Figure 3:
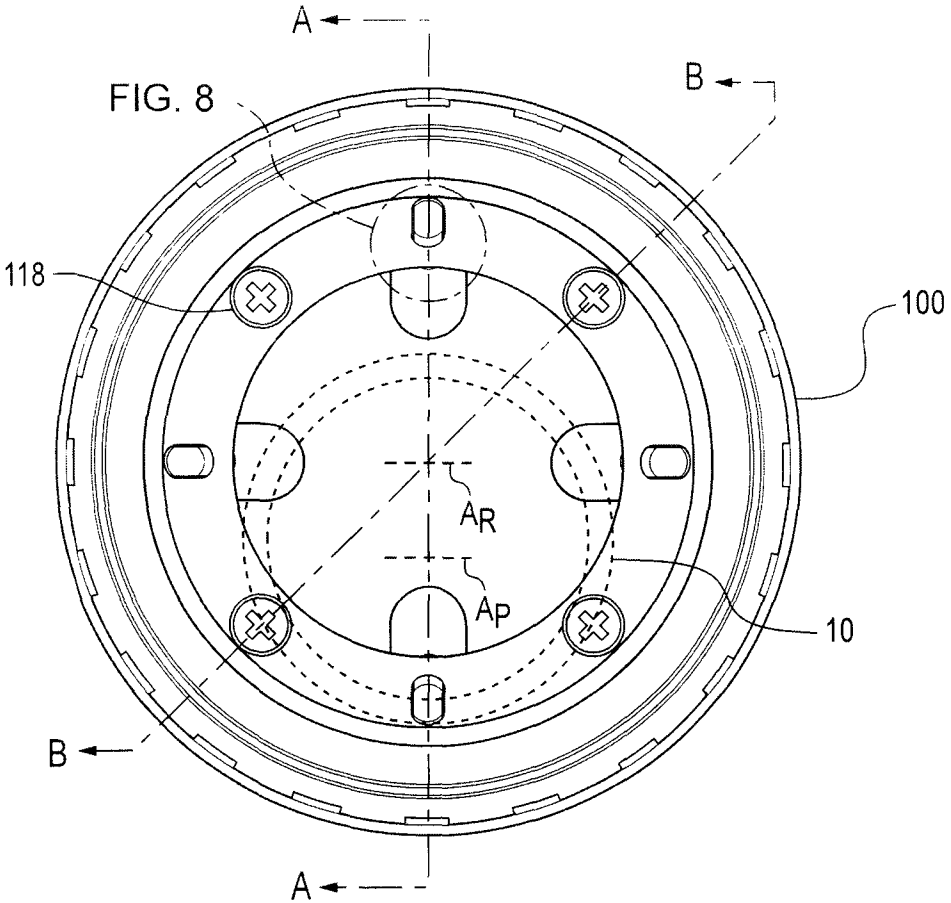
FIG. 3 is a front view of the tool and pipe shown in FIG. 1.
Figure 4:
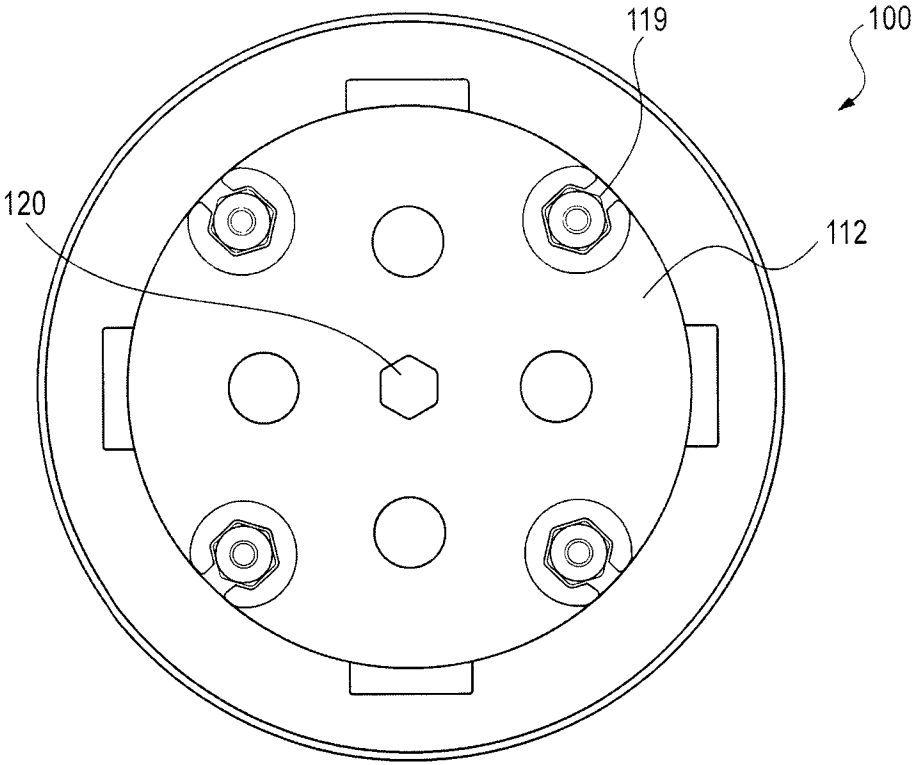
FIG. 4 is a rear view of the tool of FIG. 1.

FIGS. 1-12 illustrate a preferred embodiment tool 100 in accordance with the present invention used in conjunction with a rotary power source such as a conventional hand-held drill 30. The tool 100 is used to prepare an end or end portion of a pipe 10. In many of the figures described herein, pipes or portions of pipes are illustrated using dashed lines. Dashed lines are used to better illustrate the preferred tools and systems in accordance with the invention. FIG. 2 shows the tool 100 and a pipe 10. The drill 30 has been omitted for clarity. The tool 100 preferably includes a shaft 120 or other member for engagement with a rotary power source, such as the drill 30. FIG. 3 is a front view of the tool 100 illustrating a generally hollow interior of the tool. The pipe 10 shown in dashed lines is positioned in one of several locations within the tool depending upon the operation to be performed upon the pipe. One or more fasteners such as screws 118 described in greater detail herein may be accessible from the tool interior. FIG. 4 is a rear view of the tool 100 illustrating a rear face 112 and the shaft 120 extending therefrom. One or more fasteners 119 which engage the screws 118 may be accessible along the rear face as described herein.

Figure 5:
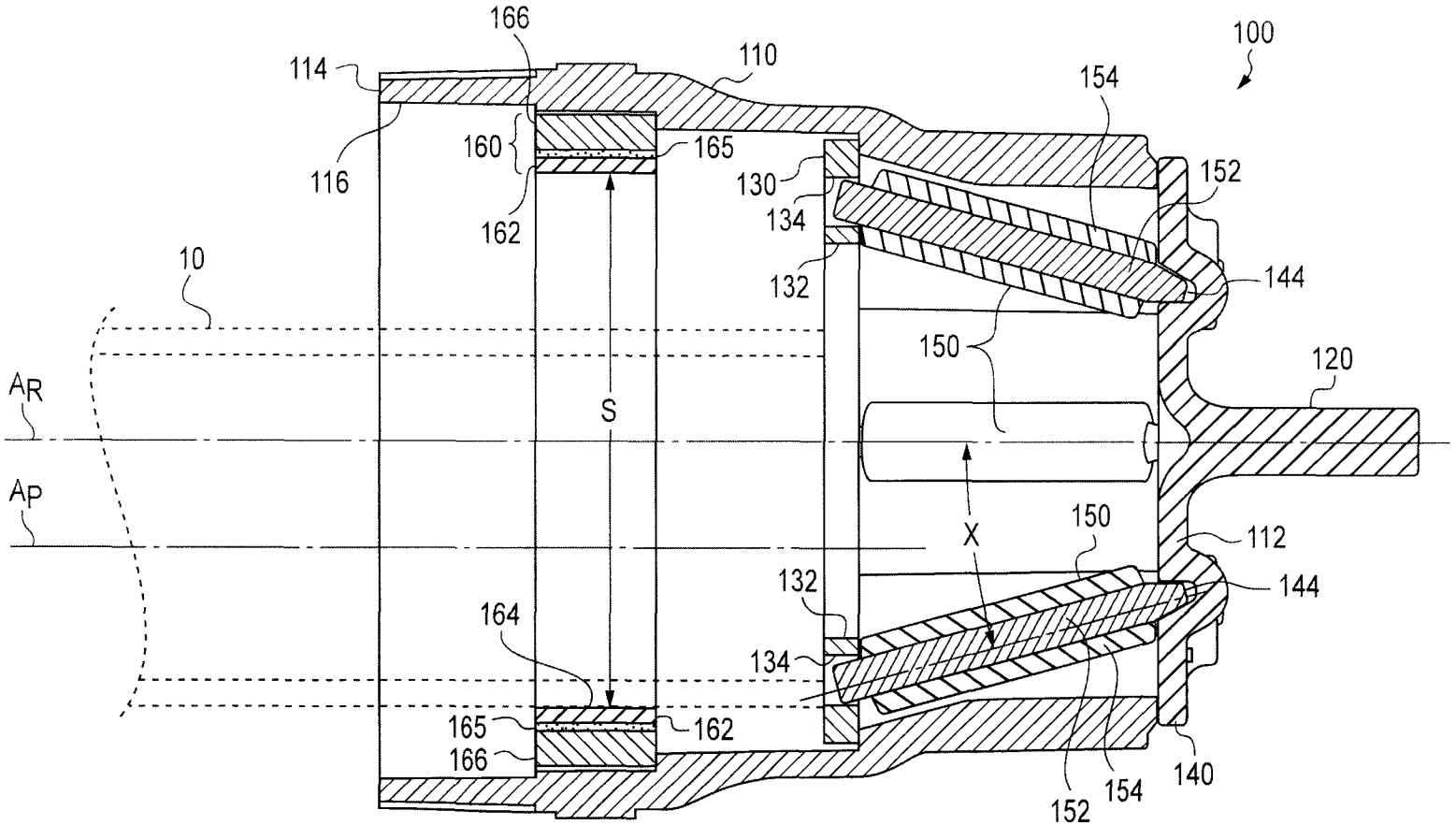
FIG. 5 is a schematic partial cross sectional view of the tool of FIG. 1 taken across line A-A in FIG. 3, showing the pipe in a first position for pipe coating removal.

Referring to FIG. 5, the tool 100 comprises a housing 110 defining the rear face 112 and an oppositely directed front face 114. The front face 114 defines a workpiece opening 116 that is sized to accommodate or receive an end of a pipe, such as pipe 10, inserted into a hollow interior region of the tool 100.

The tool 100 also includes the shaft 120 preferably extending from the rear face 112 of the housing 110. The shaft 120 is sized and configured to be engaged with the powered chuck of a rotary device such as the previously noted drill 30. Preferably, the shaft has a hexagonal shaped cross section. Preferably, the shaft extends along a longitudinal axis of the housing. The tool is rotated about the shaft and thus, the axis of rotation of the tool and the longitudinal axis of the housing are preferably collinear with one another. The axis of rotation is depicted in FIG. 5 as $A_R$.

The tool 100 also comprises a front plate 130 and a rear plate 140 spaced rearwardly from the front plate 130. Preferably, the front plate 130 is disposed within the hollow interior defined in the housing 110. The front plate 130 defines a centrally located primary aperture 132 that is large enough to receive a pipe end to be deburred. The two plates 130, 140 are spaced apart from one another and are preferably oriented parallel to one another. Furthermore, the two plates 130, 140 are preferably transversely oriented to the longitudinal axis $A_R$ of the housing 110.

The tool 100 also comprises a plurality of rollers 150 extending between the plates 130 and 140. The rollers 150 are rotatably received and supported within secondary apertures defined in the plates 130 and 140. Thus, the front plate 130 defines a plurality of secondary apertures 134 or roller receiving regions. And, the rear plate 140 defines a plurality of secondary apertures 144 or roller receiving regions. Although the preferred embodiment tools include any number of rollers, preferably from about three to about six are used and most preferably four are used. The rollers 150 are preferably equidistantly spaced from one another and symmetrically positioned about the longitudinal axis and the rotational axis $A_R$ of the tool 100.

The tool 100 also comprises an abrasive assembly 160 which includes one or more abrasive members 162 disposed within the interior hollow region of the housing 110. Preferably, the abrasive member(s) 162 is located between the front face 114 of the housing 110 and the front plate 130. The abrasive member 162 provides an inwardly directed abrasive surface 164. Preferably provided along a differently directed, e.g. oppositely directed, face of the abrasive member 162 are provisions for releasably affixing the abrasive member 162 to the housing 110. As will be understood by reference to the figures, the abrasive member 162 when positioned within the tool 100, is preferably in the form of a ring. As described in greater detail herein, the abrasive member 162 features a particular preferred construction and configuration whereby contact between the abrasive surface 164 and a pipe outer surface is promoted. In a particularly preferred version of the tool 100, the abrasive member 162 is provided in the abrasive assembly 160 that includes a deformable member 166 which is preferably a foam ring which is affixed to the interior circumferential face of the housing 110. Preferably, the foam ring is adhesively bonded to the tool housing interior face. A layer 165 providing releasable engagement with the foam ring is provided on the inwardly directed, exposed face of the foam. That layer 165 in turn retains and supports the flexible abrasive member 162. Thus, the layer 165 providing releasable engagement is preferably disposed between the abrasive member 162 and the deformable member 166. An example of a layer 165 providing releasable engagement between the abrasive member 162 and the foam ring 166 is a layer of hook and loop material, also known in the art as Velcro. These aspects are described in greater detail herein.

The tool 100 and its various components are sized, shaped, and configured to receive an end of a pipe to be deburred and/or have a region of an outer coating removed. Thus, the opening 116 defined along the front face 114 of the housing 110 and the primary opening 132 defined by the front plate 130 are both larger than the largest diameter of pipe to be prepared by the tool 100. Typically, the opening 116 is larger than the primary opening 132 defined in the front plate 130, however the invention is not limited to this particular configuration. Preferably, the two openings 116, 132 are concentrically aligned with one another. And, most preferably, both openings 116, 132 are also concentrically aligned with the axis of rotation $A_R$ of the tool 100.

Preferably, the abrasive member 162 when disposed and positioned within the interior of the tool housing 110 defines an internal span. The "internal span" as used herein refers to the dimension extending from a first location on the abrasive surface 164 to a second location on the abrasive surface 164 directly across from the first location. This internal span is illustrated in FIG. 5 as span S. Preferably, the tools and their components are configured such that the internal span S is greater than the diameter or maximum span of the primary aperture 132 in the front plate 130. Furthermore, it is generally preferred that the abrasive member 162 is equidistantly spaced from the front plate 130, when measured along a line parallel to the longitudinal axis of the housing.

The rollers 150 are rotatably supported by the front and rear plates 130 and 140, respectively, such that each of the rollers extend at an angle with respect to the axis of rotation $A_R$ (see FIG. 5) or longitudinal axis of the tool 100. Furthermore, none of the rollers 150 rotate about axes that are parallel to one another. Preferably, the rollers are oriented as depicted in FIG. 5 wherein each of the rollers is positioned at an angle of X with regard to the axis of rotation $A_R$ of the tool 100 depicted in FIG. 5. Although the invention includes a wide range of angles for angle X, preferably angle X is from about 10° to about 30°, and most preferably about 15°. It will be understood that the invention includes tools with roller orientations at angles less than 10° and greater than 30°. These values for angle X are taken along a cross section of the assembled tool, such as depicted in FIG. 5. The cross section bisects the roller of interest and also intersects the axis of rotation $A_R$ of the tool.

Figure 8:
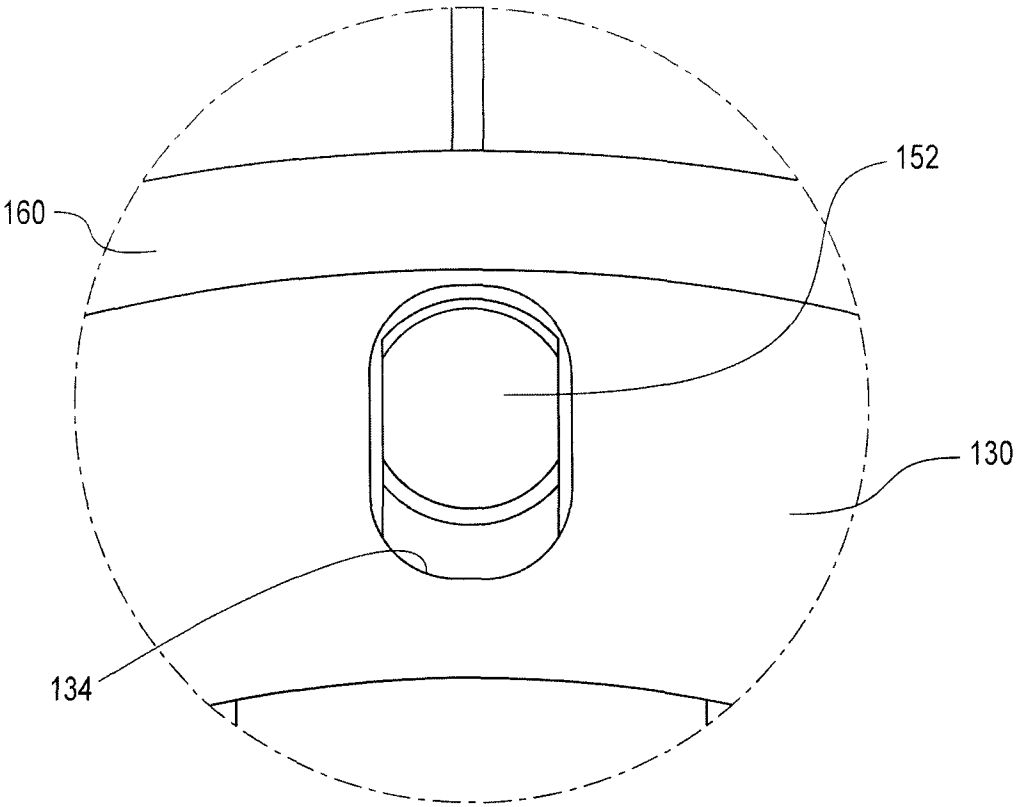
FIG. 8 is a detailed view of a preferred configuration of a roller end used in the tool depicted in FIG. 3.

The rollers 150 may be rotatably supported within the interior of the tool 100 in a variety of different configurations. Furthermore, the rollers may themselves be provided in various shapes, configurations, and assemblies. In the embodiment depicted in FIG. 5, each roller includes a centrally disposed roller axle 152 about which a roller body 154 is positioned. The roller axle 152 can include various end configurations to support the axle and engage the axle to components within the tool interior such as the front plate 130 and the rear plate 140. For example, in certain versions of the tool, the roller axle 152 is configured with two milled flat faces along a forward end that engage a slotted aperture in the front plate 130. This configuration is best depicted in FIG. 8. FIG. 8 is a detailed view illustrating a preferred configuration for the secondary apertures 134 in the front plate 130 which receive the forward ends of the roller axles 152. The preferred milled end configuration for the roller axles 152 is evident. This configuration precludes rotation of the roller axle 152. Returning attention to FIG. 5, proper angular orientation of the roller axle 152 relative to the axis of rotation $A_R$ of the tool or housing is maintained by the relationship between the receiving apertures 144 in the rear plate 140 and the secondary apertures 134 which as noted are preferably slotted, in the front plate 130. Lubricants can be applied between the interfacing surfaces of the roller axles 152 and the roller bodies 154. It is also contemplated that dry lubricant films or coatings can be provided on the axles 152 or interior bores of the roller bodies 154.

The preferred embodiment tools are sized and configured to accept and receive pipe ends as follows. That is, although the inside diameter of the housings of the preferred tools may be significantly larger than the outer diameter of the pipe of interest, preferably the inside diameter of the tool housing is within a range of dimensions, relative to the size of the pipe of interest as set forth below in Table 1:

TABLE 1

Preferred Inner Diameter of Tool Housing Compared to Pipe Size

| Steel Pipe | Nominal Pipe O.D. (inches) | Tool I.D. (inches) | Ratio I.D./O.D. |
|---|---|---|---|
| ½" Pipe | .840 | 2.315 | 2.76:1 |
| ¾" Pipe | 1.050 | 2.315 | 2.20:1 |
| 1" Pipe | 1.315 | 2.315 | 1.76:1 |
| 1¼" Pipe | 1.660 | 3.375 | 2.03:1 |
| 1½" Pipe | 1.900 | 3.375 | 1.78:1 |
| 2" Pipe | 2.375 | 3.375 | 1.42:1 |

Most preferably, the inner diameter of the tool housings corresponds to the outer diameter of pipes of interest according to the ratios noted in Table 1. Preferably, the range of ratios is from about 1.4:1 to about 2.8:1, and generally from about 1.2:1 to about 3.0:1. However, it will be appreciated that in no way is the invention limited to these particular ratios. Accordingly, the invention includes tools and the use of tool housings that are significantly larger than the ratio of 3.0:1. Table 1 also illustrates that only two differently sized tools can be used to handle a relatively wide range of pipe sizes, such as from 0.5 inch to 2 inch pipe. However, it will be understood that the invention includes the use of a single tool or three or more differently sized tools to accommodate such range of pipe sizes.

The housing 110 of the tool 100 can be formed from numerous materials and be provided in various configurations. Preferably, the housing 110 is a single piece housing that is injection molded from a polymeric material. However, as will be appreciated, the invention includes the use of other materials including metals and composite materials.

The housing 110 may optionally include a forwardly extending circumferential housing portion that serves to reduce the amount of particulates and dust produced within the interior of the tool 100. Generally, this dust extension extends from about 0.5 inches to about 2 inches or more, as measured from a frontwardly directed side region of the abrasive assembly 160 along a line parallel to the axis of rotation $A_R$ of the tool 100. Details as to additional versions and embodiments of containment provisions are provided herein.

Figure 6:
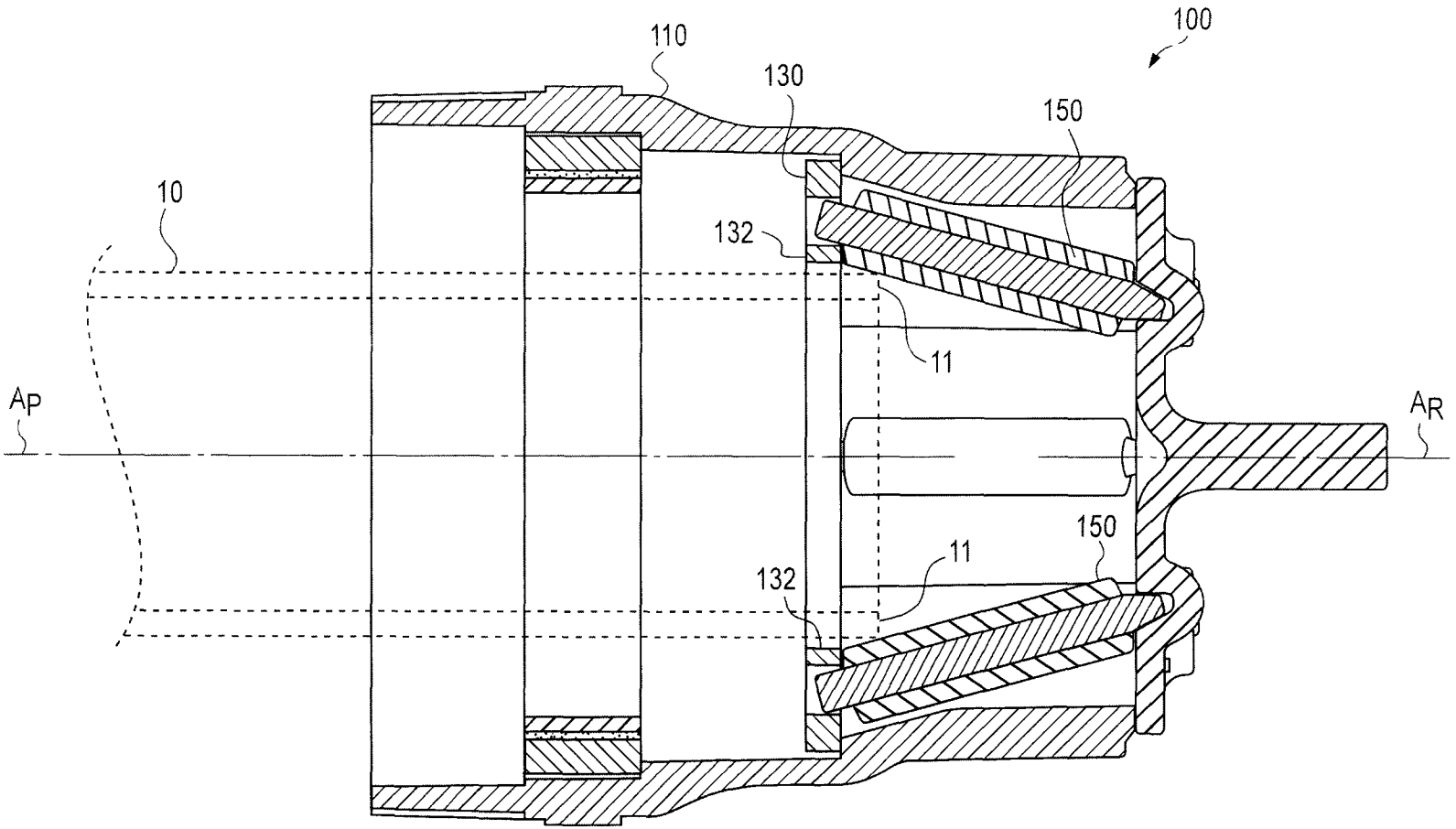
FIG. 6 is a schematic partial cross sectional view of the tool of FIG. 1 taken across line A-A in FIG. 3 showing the pipe in a second position for pipe outside diameter deburring.

FIG. 6 illustrates the tool 100 and a pipe 10 positioned within the tool while undergoing a burr removal or burnishing operation. In this configuration, the pipe 10 is concentrally positioned relative to the housing 110 such that the longitudinal axes of the two are preferably co-extensive with one another. The pipe 10 is extended through the centrally defined primary aperture 132 in the front plate 130. In performing a roller burnishing or deburring operation, the pipe 10 is held stationary such as by engagement within a pipe vise (not shown). However, the pipe could also be rotated such as by a powered rotary drive such as a RIDGID® model 300 Power Drive available from Ridge Tool. Other similar powered drives could also be used. A pipe end face 11 and particularly, an outer circumferential region of the pipe immediately adjacent to the end face 11 is contacted with the rollers 150 as shown. Upon powered rotation of the tool 100 while the pipe 10 is stationary and contact is maintained between the pipe end face 11 and the rollers 150, burrs or other outwardly extending projections are removed or substantially so whereby the pipe end is rendered smooth. In all tool embodiments described herein, it is preferred that the outer surface of the rollers is harder than that of the pipe of interest. Thus, the rollers may include outer surfaces that are carburized or otherwise hardened such that the roller hardness is greater than the hardness of the pipe, which as noted is typically steel.

Figure 7:
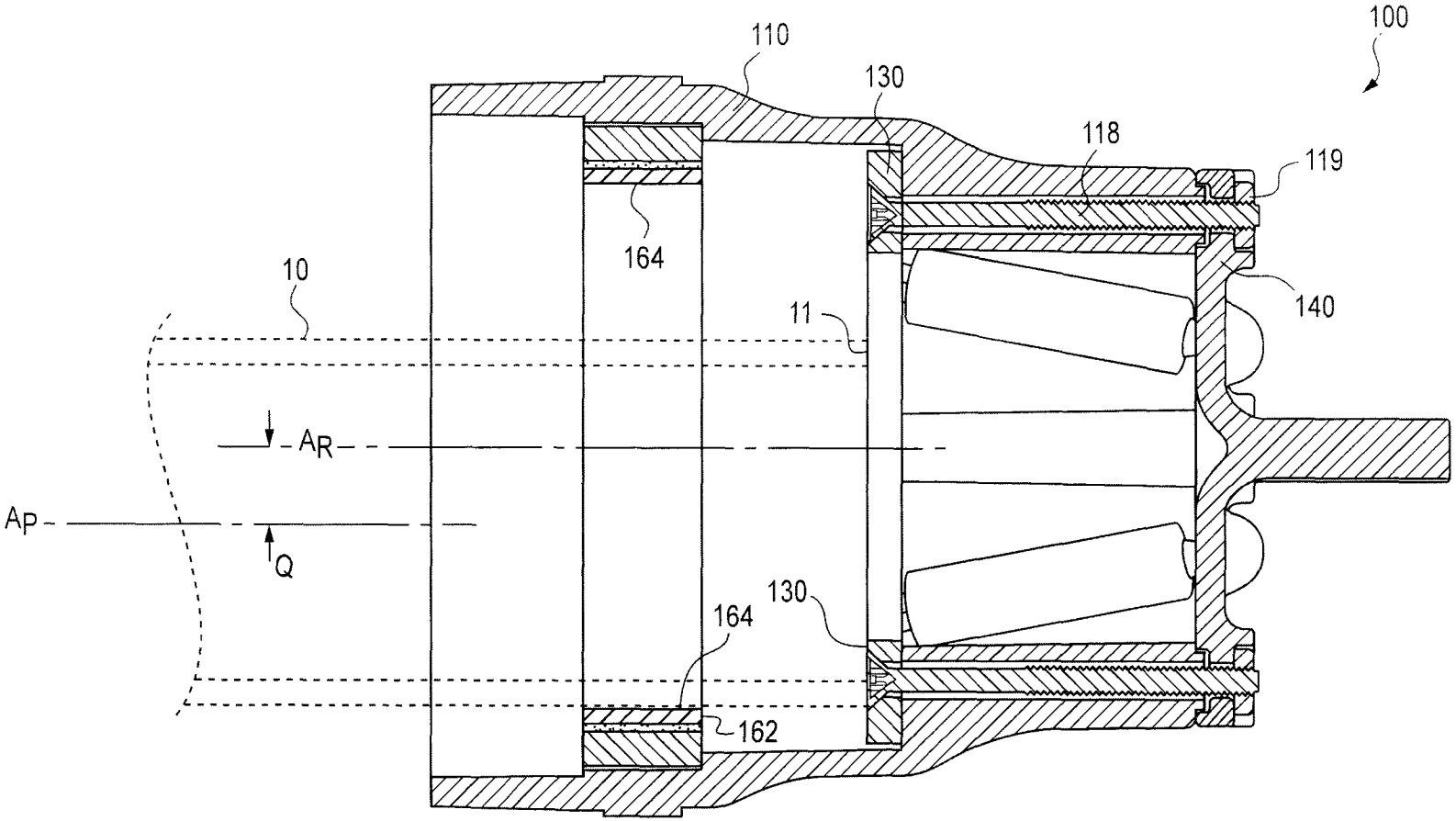
FIG. 7 is a schematic partial cross sectional view of the tool of FIG. 1 taken across line B-B in FIG. 3.

FIG. 7 illustrates the tool 100 and a pipe 10 positioned within the interior of the housing 110 while undergoing a pipe coating removal operation. In this configuration, the pipe having a longitudinal axis $A_P$ is oriented generally parallel with the axis of rotation $A_R$ of the housing, yet spaced therefrom. FIG. 7 illustrates this distance between the axis of rotation of the tool $A_R$ and the longitudinal axis of the pipe $A_P$ as distance Q. It will be appreciated that the pipe is preferably positioned such that its longitudinal axis $A_P$ is parallel or substantially so to the tool axis of rotation $A_R$. The pipe 10 is radially spaced from the axis of rotation of the tool 100 such that contact occurs (i) between a region of the outer surface of the pipe 10 and the face 164 of the abrasive member 162, and (ii) between the end face 11 of the pipe 10 and the forwardly directed face of the front plate 130. Further description of the pipe coating removal operation is provided in association with FIG. 9. As shown in FIG. 7, while in this configuration, contact occurs between the pipe end 11 and the front plate 130. Accordingly, the front plate 130 may be formed from wear-resistant materials and/or receive wear-resistant coatings. The front plate 130 serves as a stop for a pipe 10 while undergoing the operation depicted in FIGS. 7 and 9. FIG. 7 also illustrates a fastener configuration in which the previously noted screws 118 pass through tapered clearance holes defined in the front plate 130 to allow the heads of the screws 118 to be slightly recessed from the front surface of front plate 130 and engage the previously noted fasteners 119 which can be hex nuts retained in hexagonal recesses defined in the rear plate 140.

Figure 9:
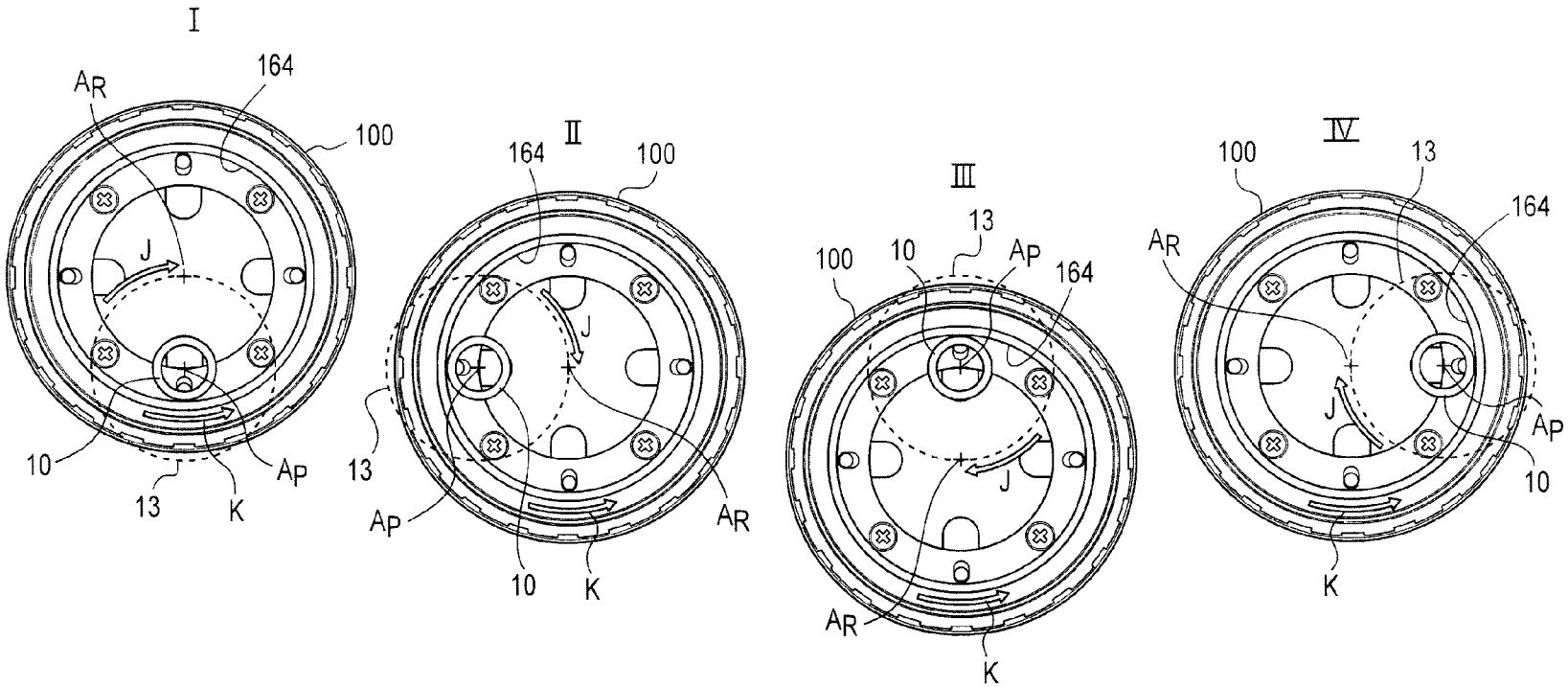
FIG. 9 illustrates various arrangements of the preferred embodiment tool and a pipe at four different phases during a preferred embodiment method for pipe coating removal in accordance with the invention.

FIG. 9 schematically illustrates a preferred technique for preparing an outer surface region of a pipe 10. The technique depicted in FIG. 9 is performed when it is most convenient to hold the pipe stationary such as in a pipe vise (not shown). In this method, the pipe 10 is generally immobile or otherwise held stationary. The tool 100 mounts into a conventional hand drill (not shown) and the drill motor is actuated so that the axis of the drill chuck and that of the tool 100 rotates at a speed preferably within the range of from about 1,500 to about 3,000 RPM. This axis is the axis of rotation $A_R$. However, it will be understood the preferred methods include rotary speeds less than or greater than this range. The tool 100 is engaged onto the end of the pipe 10 which is to be prepared. The tool 100 is then orbited at a very slow speed, such as less than about 10 RPM, around the axis of the pipe $A_P$ as shown in FIG. 9, while the drill chuck is rotated at about 1,500 to about 3,000 RPM. The end preparation operation begins at position I where the pipe 10 is at the 6 o'clock position relative to the axis of the drill motor chuck, i.e. axis $A_R$. With the drill chuck rotating counterclockwise (as viewed looking toward the chuck end of the drill), the entire drill assembly is then rotated in a clockwise direction (as viewed looking toward the chuck end of the drill) through positions II, III, and IV. The direction about which the tool 100 is orbited about the pipe 10 is depicted in FIG. 9 as direction J. As the tool 100 is orbited about the pipe 10, the centerline of the tool 100 (also corresponding to the axis of rotation $A_R$ of the tool 100) traces a circular path around the pipe 10. The circular trace is illustrated in FIG. 9 as path 13. This allows the abrasive face 164 to contact the entire periphery of the pipe 10 within a circumferential band extending along the outer surface of the pipe. This operation typically continues for three to five complete orbits about the pipe 10 to entirely remove the black coating from the steel pipe within the circumferential band. In accordance with this preferred technique, it will be appreciated that the drill and tool 100 are orbited about the pipe 10 in the direction J that is opposite to the direction of rotation K of the tool 100 as it is being rotated by the drill motor.

Figure 10:
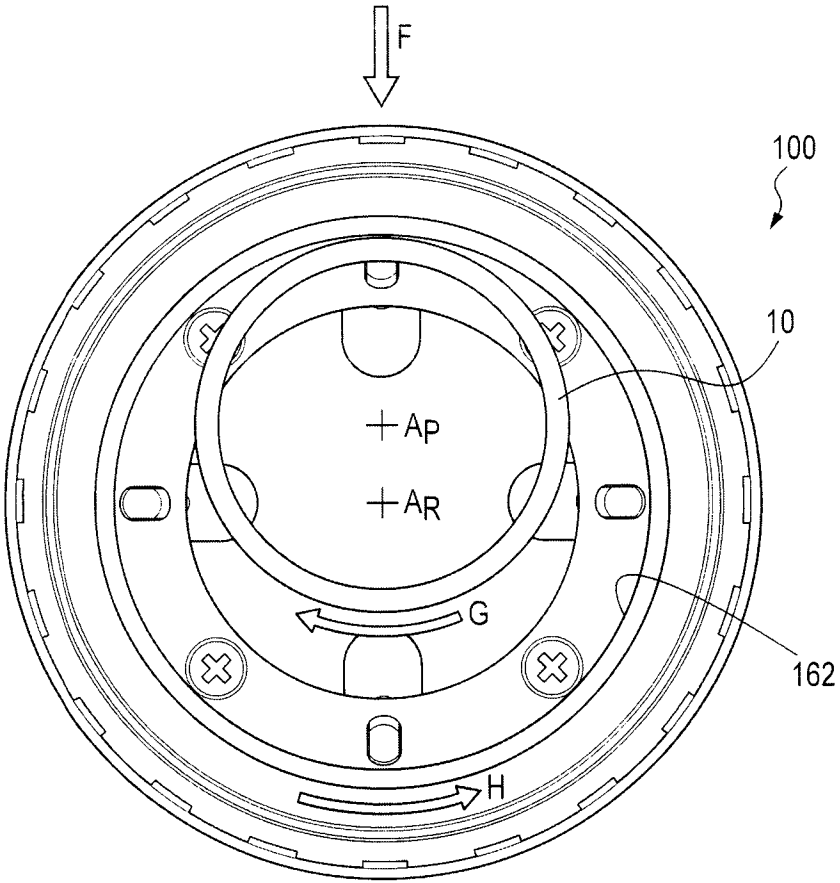
FIG. 10 is a front view of the preferred embodiment tool of FIG. 1 during another preferred embodiment method for pipe coating removal in accordance with the invention.

FIG. 10 depicts an alternative method for removing a region of coating from the outer surface of a pipe 10 using the preferred embodiment tool 100. In this alternative method, the pipe 10 is rotated about its longitudinal axis $A_P$ while the tool is simultaneously rotated about the longitudinal axis of the tool housing $A_R$ and held in a position relative to the tool 100 such as depicted in FIG. 10. Preferably, the direction of rotation of the tool 100 is opposite that of the direction of rotation of the pipe rotation. This preferred configuration is depicted by oppositely directed arrows G and H shown in FIG. 10. The pipe 10 can be conveniently rotated by use of a powered rotary drive, which may be provided or used in association with a threading machine. A preferred powered drive is a RIDGID® Model 300 Power Drive. Preferably, the pipe is rotated at a relatively slow speed, such as from about 10 to about 50 RPM, and preferably about 38 RPM. During this operation, an operator applies a radial force F to the tool 100 to urge the abrasive member 162 of the tool in contact with the outer surface of the pipe 10. To ensure that the proper region of pipe coating is removed relative to the distance from the end of the pipe, the tool 100 is also held to maintain contact between the end of the pipe such as previously noted end face 11 and the front plate 130.

Figure 11:
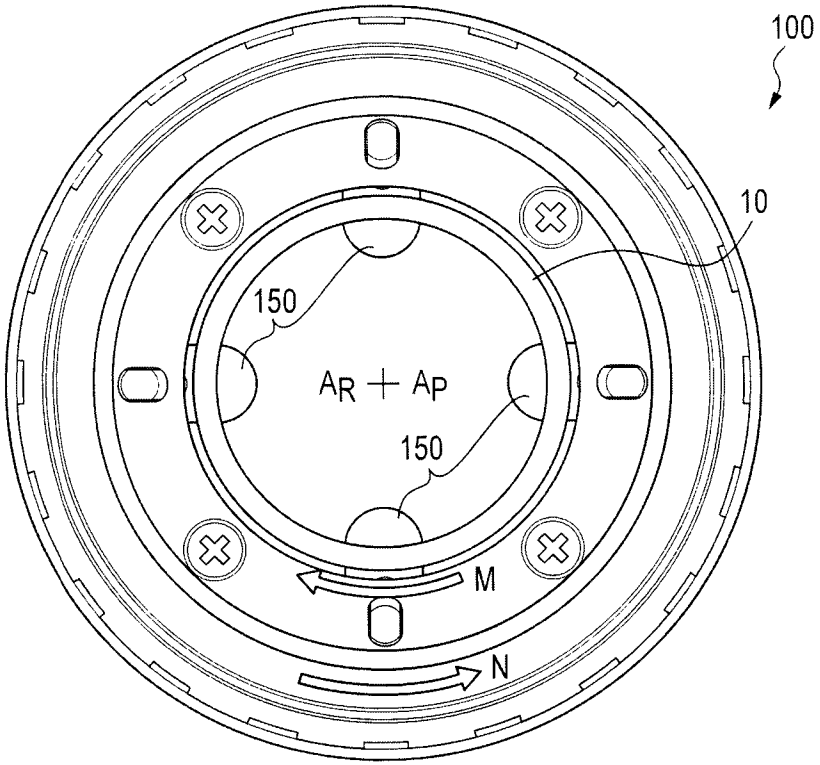
FIG. 11 is a front view of the preferred embodiment tool of FIG. 1 during another preferred embodiment method for pipe deburring according to the invention.

FIG. 11 illustrates an alternative method of using the preferred embodiment tool 100 for burr removal or burnishing the end face 11 of a pipe 10. In this alternative method, the pipe 10 is rotated about its longitudinal axis, such as by use of the previously noted powered drive. The longitudinal axis $A_P$ of the pipe 10 is coincident with the rotational axis $A_R$ of the tool 100. In this method, the pipe end is inserted within the tool 100 as shown in FIG. 6. The pipe 10 is held or otherwise positioned such that the longitudinal axis of the pipe is coincident or co-extensive with the longitudinal axis of the housing. The tool 100 is preferably rotated about its longitudinal axis. Preferably, the directions of rotation of the pipe and the housing are opposite from one another. The tool 100 is rotated in the direction N. Preferably, the pipe is rotated in direction M at a relatively slow speed, such as from about 10 to about 50 RPM, and most preferably about 38 RPM. The operator applies axial force to the pipe end and the rotating action of the rollers 150 about the slowly rotating pipe 10 promotes the roller burnishing operation.

Figure 12:
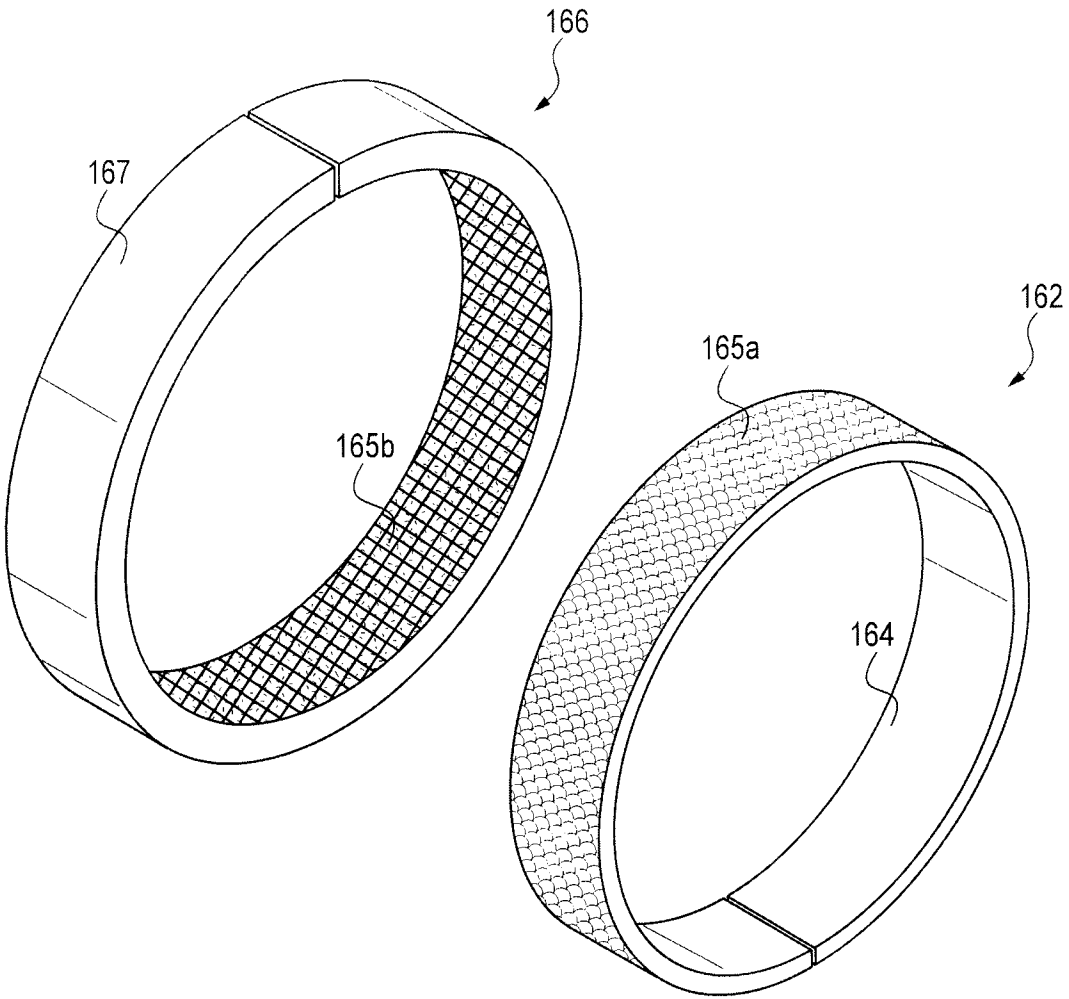
FIG. 12 is a perspective partially exploded schematic view of certain components used in the preferred embodiment tool of FIG. 1.

FIG. 12 is a schematic exploded assembly view of a compliant foam layer 166 and an abrasive member 162 in their as-installed ring-like shapes. The term "compliant" as used herein refers to the material disposed between the abrasive member 162 and the tool housing (not shown) as being compressible or deformable upon application of a load or force encountered during a pipe end preparation operation. After removal of the load or force resulting in compression or deformation, the compliant material returns to its original shape or substantially so. An example of such load or force resulting in compression or deformation of the compliant material is the radial force applied to a pipe by an operator in establishing contact between the pipe and the abrasive member. The foam layer 166 is preferably a strip of a deformable, compliant foam material having a layer of a "hook" material 165*b* along its inner face. The outer face 167 of the foam layer 166 is bonded or otherwise affixed to the circumferential interior wall of the tool housing. The abrasive member 162 includes a strip of material having a layer of "loop" material 165*a* along its outer face. Preferably, the materials 165*a* and 165*b* constitute the previously described layer 165 which provides releasable engagement between the foam ring 166 and the abrasive member 162. The abrasive face 164 extends along the inner face of the abrasive member 162. It will be understood that the arrangement of the hook and loop materials may be reversed.

Although a wide array of materials can be used for the deformable member 166 which is preferably a foam material, preferably from about 0.0625 inch to about 0.5 inch, and more preferably about 0.25 inch thick compliant foam with double sided tape type adhesion on its outer face is used to provide permanent adhesion to the inner face of the tool housing. Although the foam member is preferably adhesively bonded to the inner face of the housing, it will be appreciated that numerous other affixment techniques can be used such as for example, screws, clips, or the use of other mechanical fasteners.

The abrasive member 162 is preferably formed of an abrasive material that is permanently bonded to a heavy duty scrim backing. The term "scrim" as used herein refers to a web-like fibrous layer typically formed from a collection of non-woven fibers. The scrim layer may function as a "loop" material when using releasably engageable hook and loop materials. For certain applications, when using non-woven abrasive products, it may not be necessary to use a deformable or compliant layer. Preferably, abrasive materials in granular or particulate form having a relatively high hardness are dispersed and retained in a substrate or matrix. The substrate or matrix is bonded or secured to a scrim backing. The resulting exposed face or outer surface of the abrasive member consists of a series of projections and valleys, with the high hardness materials constituting the projections. This material arrangement is preferred over arrangements of inwardly directed wires, bristles, or other members as is known in the art. Upon excessive wear of the abrasive members used in the preferred embodiment tools described herein, the abrasive member can be easily and conveniently replaced with a new abrasive member without necessity for additional tools. Abrasive materials are well known in the art and are widely available. Examples of preferred abrasive materials include, but are not limited to aluminum oxide grain abrasive particulates or silicon carbide particulates permanently bonded to a heavy duty scrim backing.

As noted, a wide array of abrasive materials can be used in the abrasive assemblies and/or for the abrasive members. Although abrasive strips such as strips of thin backing material containing an abrasive face can be used in many applications and particularly in combination with a compliant or deformable layer, for certain applications it is most preferred to use a relatively thick non-woven abrasive material for the abrasive member(s). When using such non-woven abrasive materials, since the entire thickness of the member (as measured in a radial direction when incorporated in a tool as described herein) constitutes abrasive material, the member has a relatively long life. As the exposed abrasive face of the abrasive member is worn, new abrasive regions along the exposed face are revealed. For ring-shaped abrasive members formed from a non-woven abrasive material, as the member wears, a constantly refreshed abrasive face is continually exposed as a result of use of the tools, for example in removing coatings from the outer diameters of pipes. As the internal span (for example span S in FIG. 5) increases with wear of the abrasive member, the abrasive member is still usable and functional. The ring shaped abrasive member can continue to be used, limited only by its remaining thickness. Another advantage of the use of a non-woven abrasive material is that such material has relatively large voids and thus is generally resistant to "clogging" or loss of abrasive action from debris and particulates collecting on or within the abrasive face.

Figure 13:
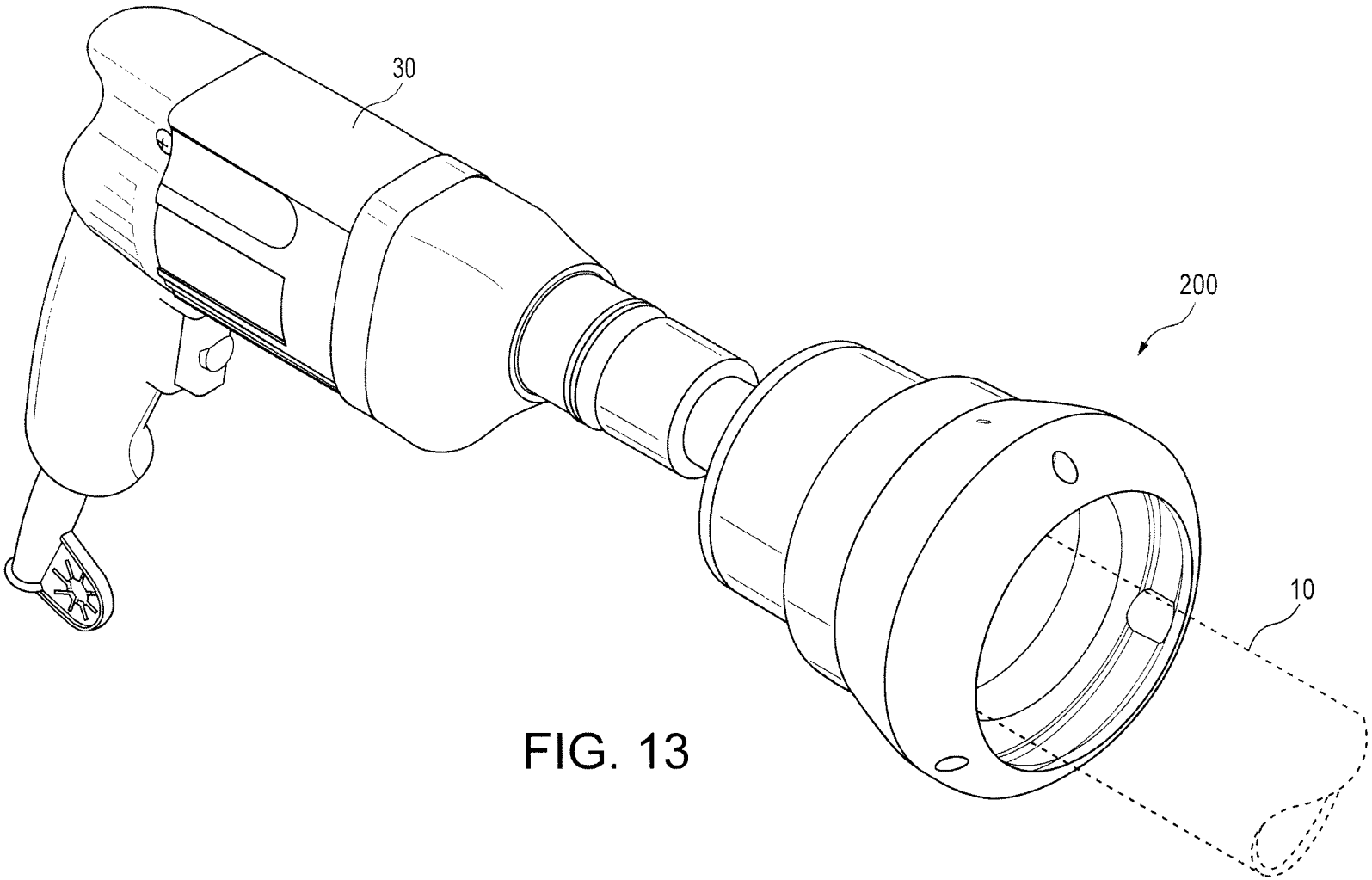
FIG. 13 is a perspective view of another preferred embodiment tool in accordance with the present invention, used with a drill and a pipe.
Figure 14:
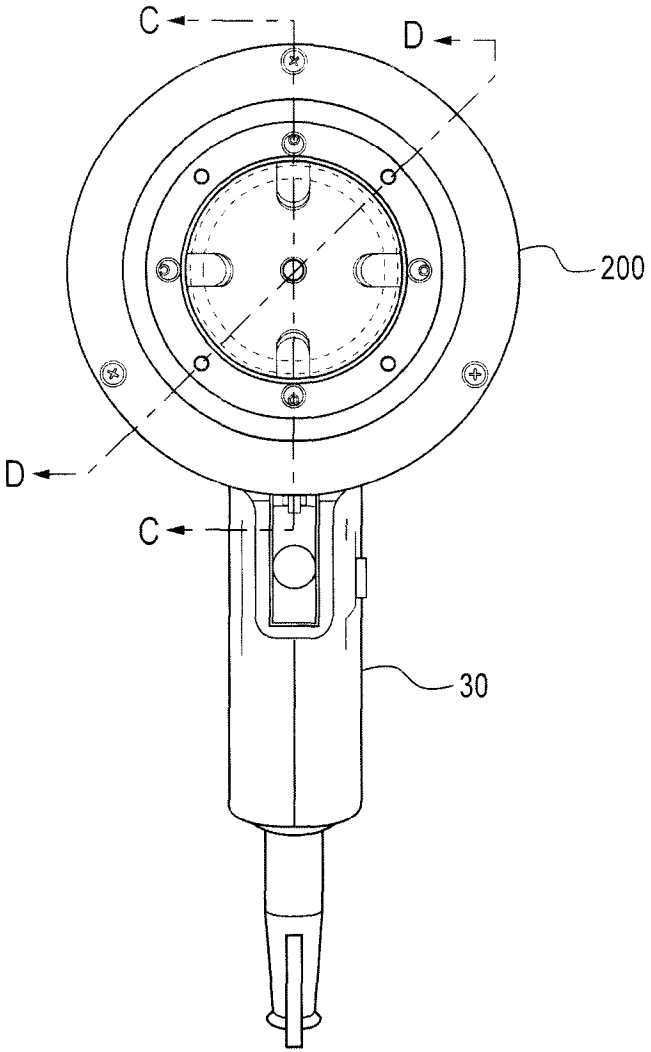
FIG. 14 is a front view of the tool, drill, and pipe illustrated in FIG. 13.
Figure 15:
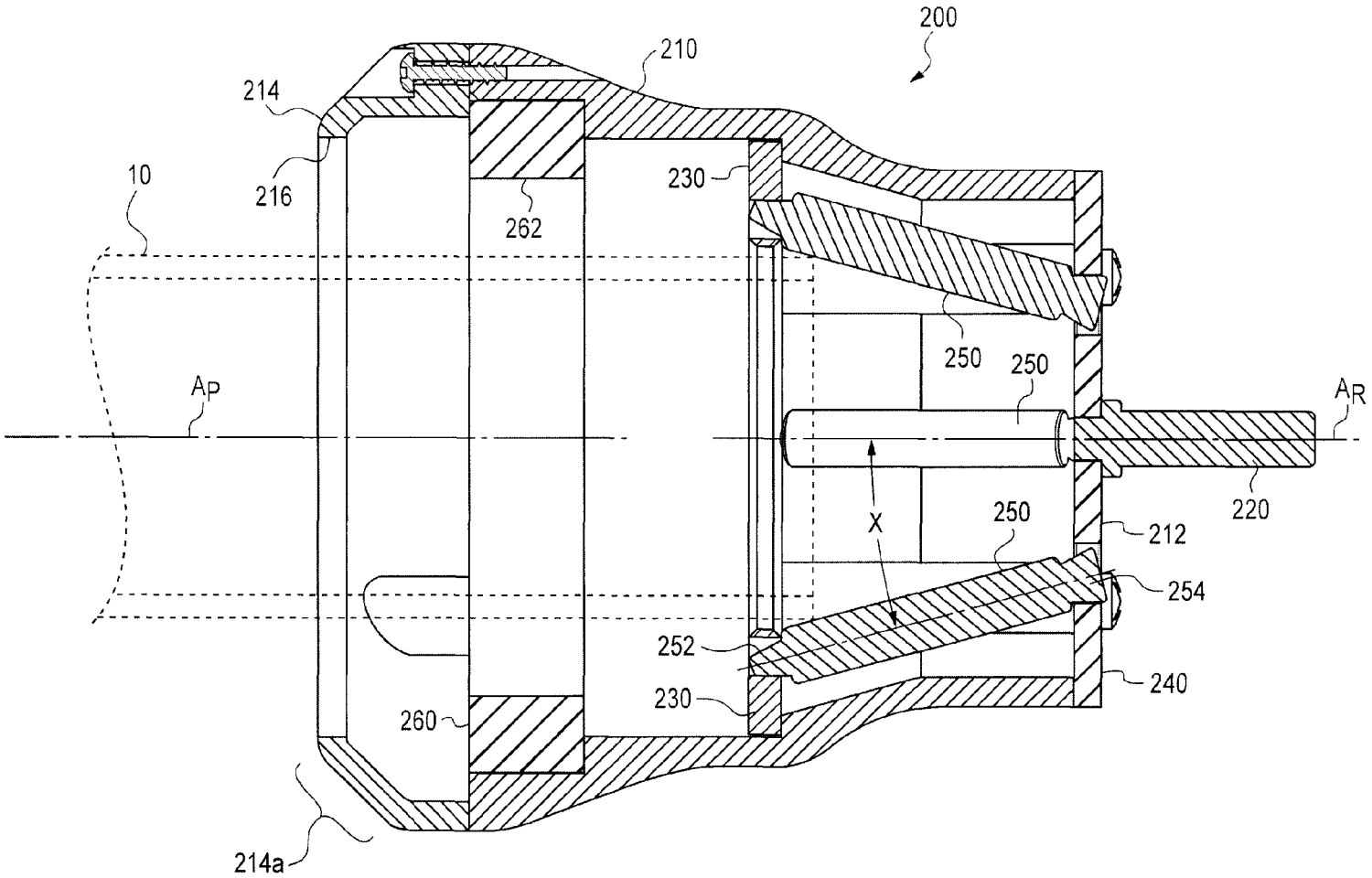
FIG. 15 is a schematic partial cross sectional view of the preferred embodiment tool of FIG. 13, shown without attachment to a drill, taken across line C-C in FIG. 14.

FIGS. 13-17 illustrate another preferred embodiment tool 200 in accordance with the present invention used in conjunction with a rotary power source such as a conventional hand-held drill 30. FIG. 13 is a perspective view of the tool 200, the drill 30, and a pipe 10. FIG. 14 is a front view of the various components. Referring to FIG. 15, the tool 200 comprises a housing 210 defining a rear face 212 and an oppositely directed front face 214. Preferably, the front face 214 includes an inwardly tapered section 214*a* which extends radially inward for promoting dust and particulate collection. The front face 214 defines a workpiece opening 216 that is sized to accommodate or receive an end of a pipe, such as pipe 10, inserted into a hollow interior region of the tool 200. The tool 200 also includes a shaft 220 preferably extending from the rear face 212 of the housing 210. The shaft 220 is sized and configured to be engaged with the powered chuck of a rotary device such as the previously noted drill 30. The tool 200 also comprises a front plate 230 and a rear plate 240 spaced rearwardly from the front plate 230. Preferably, the front plate 230 is disposed within the hollow interior defined in the housing 210. The front plate 230 defines a centrally located aperture that is large enough to receive a pipe end to be deburred. The two plates are spaced apart from one another and are preferably oriented parallel to one another. The tool 200 also comprises a plurality of rollers 250 extending between the plates 230 and 240. The rollers 250 are rotatably received and supported by apertures defined in the plates 230 and 240. Although the invention includes any number of rollers, preferably from about three to about six are used and most preferably four are used. The rollers are preferably equidistantly spaced from one another and symmetrically positioned about the longitudinal axis and the rotational axis of the tool 200. The longitudinal axis and the rotational axis of the tool are preferably collinear with one another.

The tool 200 also comprises one or more abrasive members 260 disposed within the interior hollow region of the housing 210. Preferably, the abrasive member 260 is located between the front face 214 of the housing 210 and the front plate 230. The abrasive member 260 provides an inwardly directed abrasive surface 262. As described in greater detail herein, the abrasive member 260 features a particular preferred construction and configuration whereby contact between the abrasive surface 262 and a pipe outer surface is promoted.

The tool 200 and its various components are sized, shaped, and configured to receive an end of a pipe to be deburred and/or have a region of an outer coating removed. Thus, the opening 216 defined along the front face 214 of the housing 210 and the opening defined by the front plate 230 are both larger than the largest diameter of pipe to be prepared by the tool 200. Typically, the opening 216 is larger than that defined in the front plate 230, however the invention is not limited to this particular configuration. Preferably, the two openings are concentrically aligned with one another.

The rollers 250 are rotatably supported by the front and rear plates 230 and 240, respectively, such that the rollers extend at an angle with respect to the axis of rotation of the tool 200. That is, none of the rollers 250 rotate about axes that are parallel to one another. Preferably, the rollers are oriented as depicted in FIG. 15 wherein the rollers are positioned at an angle of X with regard to the axis of rotation $A_R$ of the tool 200 depicted in FIG. 15. Although the invention includes a wide range of angles for angle X, preferably angle X is from about 10° to about 30°, and most preferably about 15°. It will be understood that the invention includes tools with roller orientations at angles less than 10° and greater than 30°.

Another preferred aspect of the tool 200 is the configuration of the ends of the rollers 250. As depicted in FIG. 15, by forming a forward end 252 of the roller 250 with converging side walls, and a rearward end 254 of the roller 250 with diverging side walls, the receiving apertures defined in the front plate 230 and the rear plate 240 can be formed by drilling operations that are transversely oriented relative to the plane of the plates 230, 240. Thus, relatively costly drilling procedures in which receiving apertures are formed at angles less than 90° relative to the plane of the plates 230, 240 can be avoided. It is contemplated that bearings or roller ends could also be utilized at the interface between the rollers and the apertures. Representative examples of bearings include sleeve type, sleeve flanged type or rolling element type.

Figure 16:
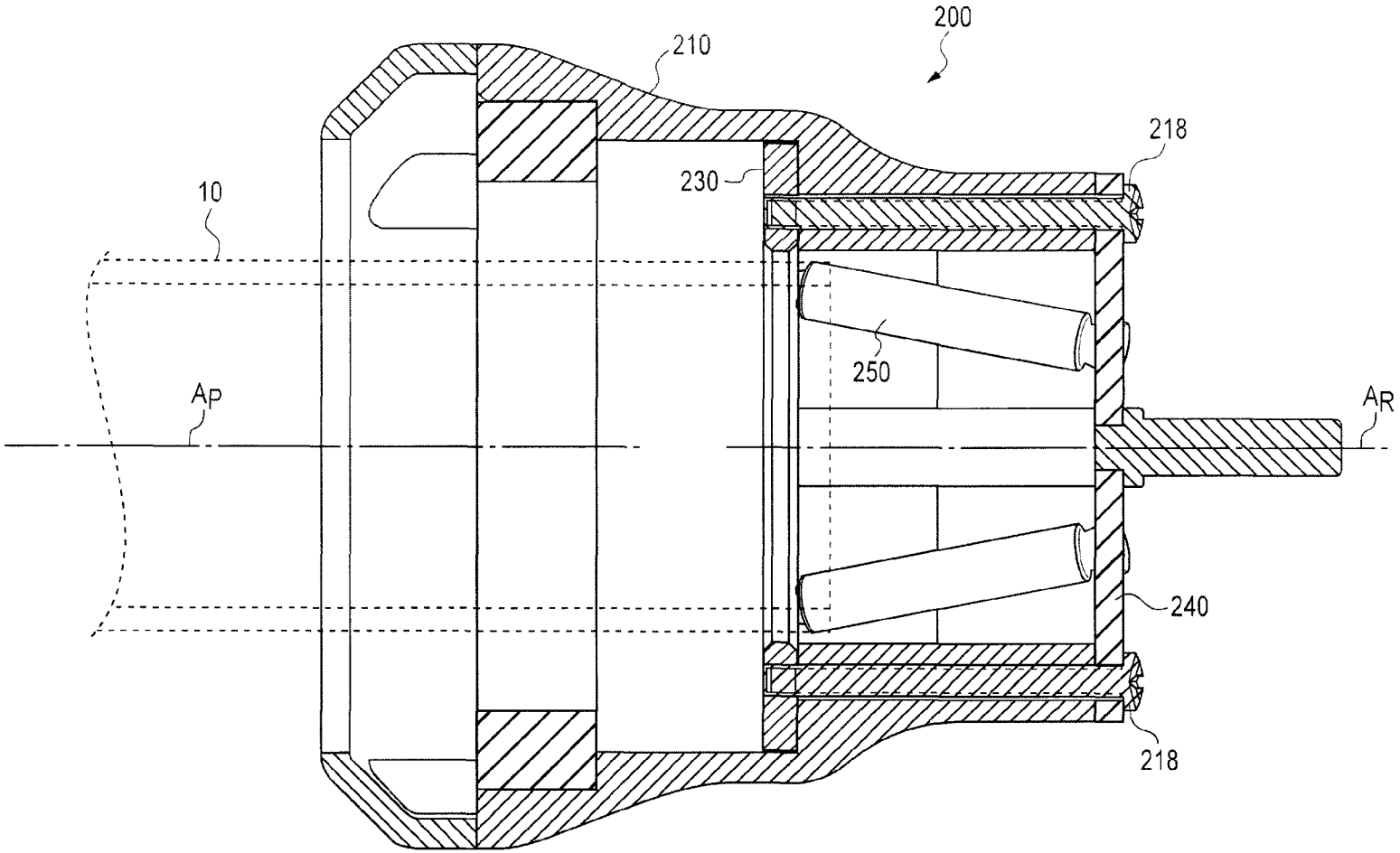
FIG. 16 is a schematic partial cross sectional view of the preferred embodiment tool of FIG. 13, taken across line D-D in FIG. 14.

FIG. 16 illustrates an alternative clarifying view of the tool 200 illustrating one possible configuration as to how the front and rear plates 230, 240 are affixed to the housing 210 and spaced from one another by a plurality of housing screws 218. In this alternative configuration, the screws 218 or other fasteners are inserted into apertures defined in the rear plate 240, accessible along a rearward face of the rear plate 240. The screws 218 extend forwardly into corresponding and aligned threaded apertures in the front plate 230. This is in contrast to the configuration previously described in association with FIGS. 4 and 7 in which screws 118 are inserted into a front face of the front plate 130 rearwardly and engaged with hex nuts 119 or other fasteners along a rear face of the rear plate 140.

Figure 17:
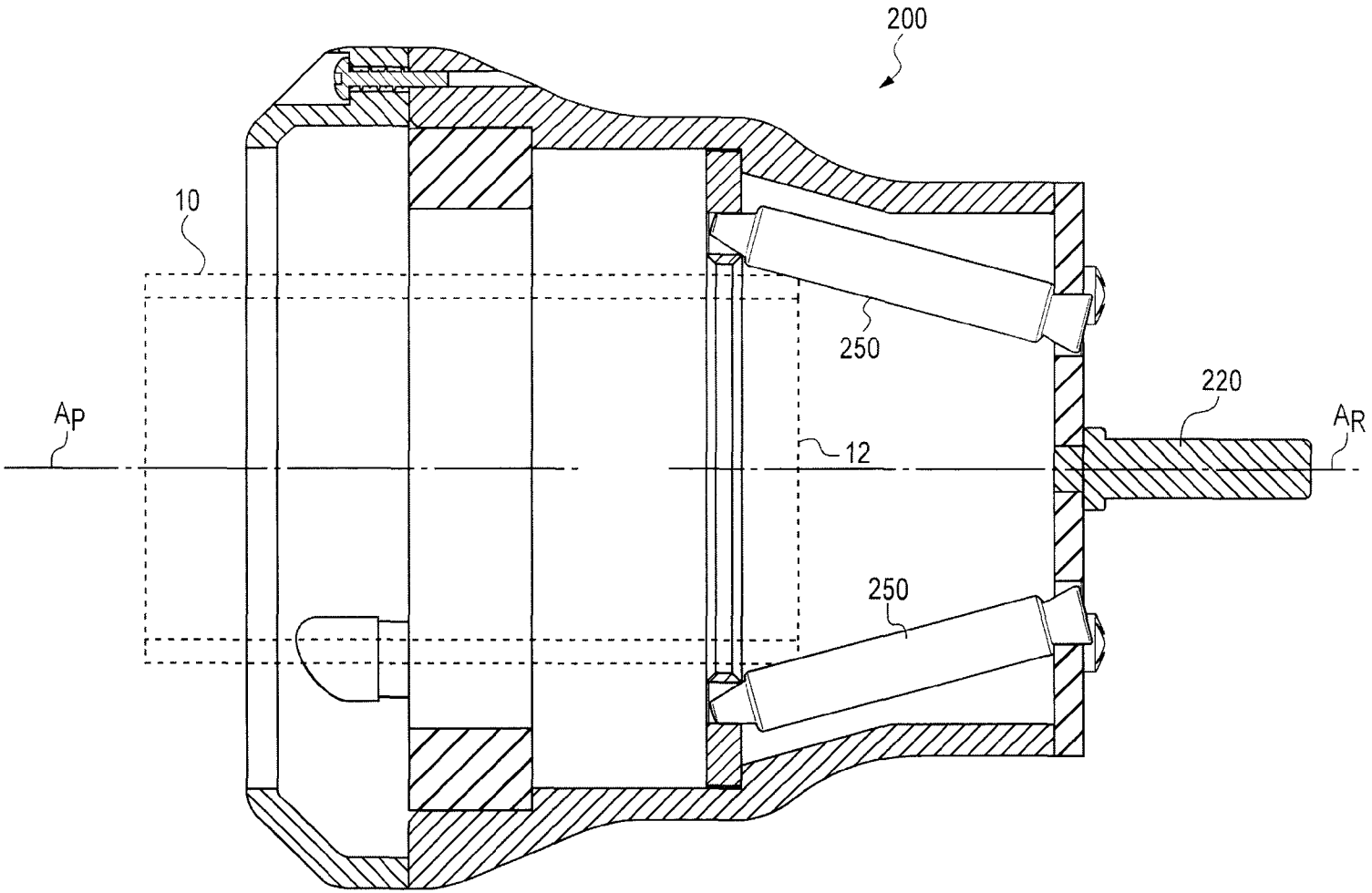
FIG. 17 illustrates a schematic partial cross sectional view during use of the tool of FIG. 13 in a deburring operation.
Figure 18:
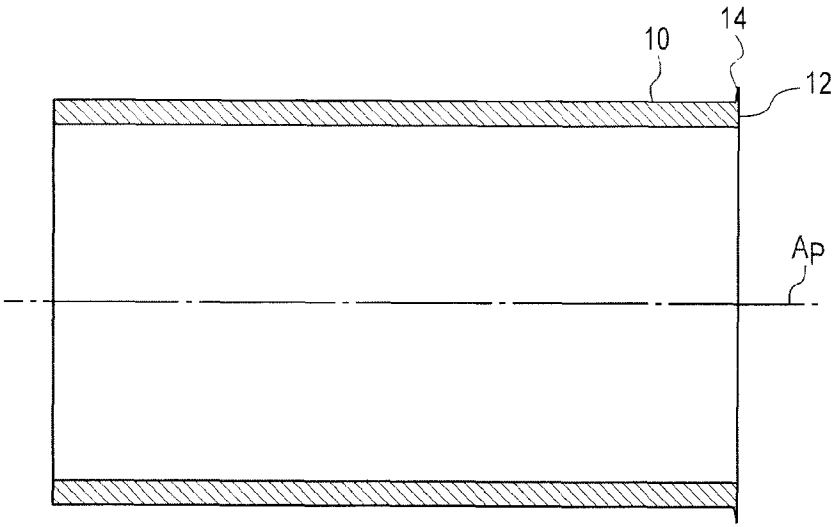
FIG. 18 is a schematic cross sectional view of a pipe end before use of the tool.
Figure 20:
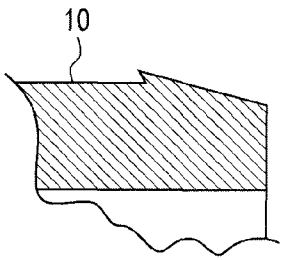
FIG. 20 is a schematic detailed end view of the pipe end after use of the preferred embodiment tools.
Figure 19:
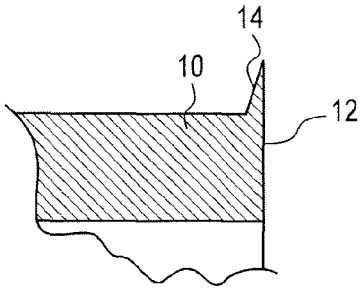
FIG. 19 is a schematic detailed end view of the pipe end of FIG. 18 before use of the tool.

The use and operation of the tool 200 for the burr removal portion of the pipe end preparation process is described in conjunction with FIGS. 17-20. FIG. 17 illustrates a typical operation using the tool 200 by inserting an end 12 of a pipe 10 having one or more burrs 14 (see FIGS. 18 and 19) extending from the end 12. The pipe 10 is held stationary to prevent rotation such as by clamping into a pipe vise (not shown). The pipe 10 is then inserted into the hollow interior region of the tool 200 until its end 12 contacts the outer surfaces of the plurality of rollers 250. The tool 200 is then rotated about the axis of rotation $A_R$, such as by engagement with a drill (not shown) at the shaft 220. The tool 200 is pressed by hand effort against the end 12 of the pipe 10 to thereby apply an axial force component and a radial force component onto the pipe end via the inclined rollers 250. As the tool 200 is rotated about the stationary pipe 10, any burrs 14 extending outward from the pipe end 12 are removed or reformed as shown in the detailed schematic illustration of FIG. 20.

Figure 21:
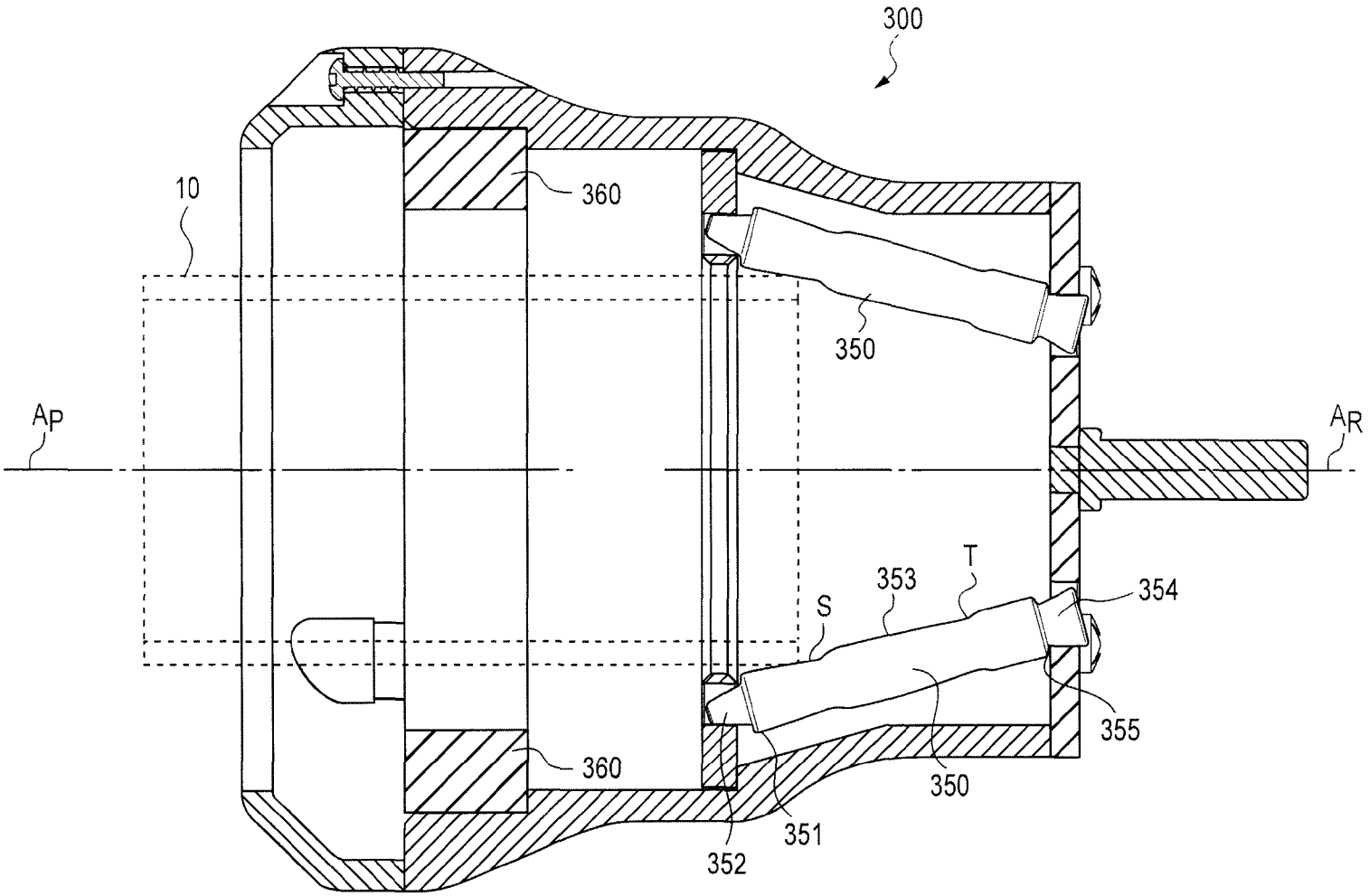
FIG. 21 is a schematic partial cross sectional view illustrating use of another preferred embodiment tool in a deburring operation.

FIG. 21 illustrates another preferred embodiment tool 300 in accordance with the present invention. In this embodiment, the tool 300 includes rollers 350, each having a particular configuration as follows. A representative preferred configuration for roller 350 is as follows. The roller 350 defines a first cylindrical end 351 which is proximate a forward end 352 of the roller 350. The roller 350 also defines a second cylindrical end 355 opposite the first cylindrical end 351, the second end 355 proximate a rearward end 354 of the roller 350. At a location between the first cylindrical end 351 and the second cylindrical end 355, the roller 350 defines at least one, and preferably two recessed regions extending around the roller such as a recessed ring S and a recessed ring T. The outer arcuate surface of the roller extending between the first cylindrical end 351 and the recessed ring S provides a deburring surface for a first pipe size. The outer arcuate surface of the roller extending between the rings S and T provides another deburring surface for a second pipe size, different than the first pipe size. It will be recognized that any number of deburring surfaces could be included to accommodate various standard outside pipe diameters. Preferably, a raised region 353 is defined along the outer circumferential surface of the roller 350 between the recesses S and T. And thus, the outer arcuate surface of the roller extending between the raised region 353 and the recessed ring T provides a deburring surface for pipe having a diameter smaller than that of pipe deburred by the roller region between the end 351 and the ring S. Regardless of the particular geometry or roller configuration, it is generally preferred that the effective angle of the roller in the region of contact is reduced since smaller angles, for example about 10°, improve roller burnishing. The preferred embodiment tools provide small contact angles without requiring an increased axial length of the tool. It will be appreciated that the present invention includes a wide array of shapes and configurations for the roller 350 and in no way is limited to the particular shape illustrated in FIG. 21. Other aspects of the tool 300 are as previously described tools 100 and 200.

Figure 22:
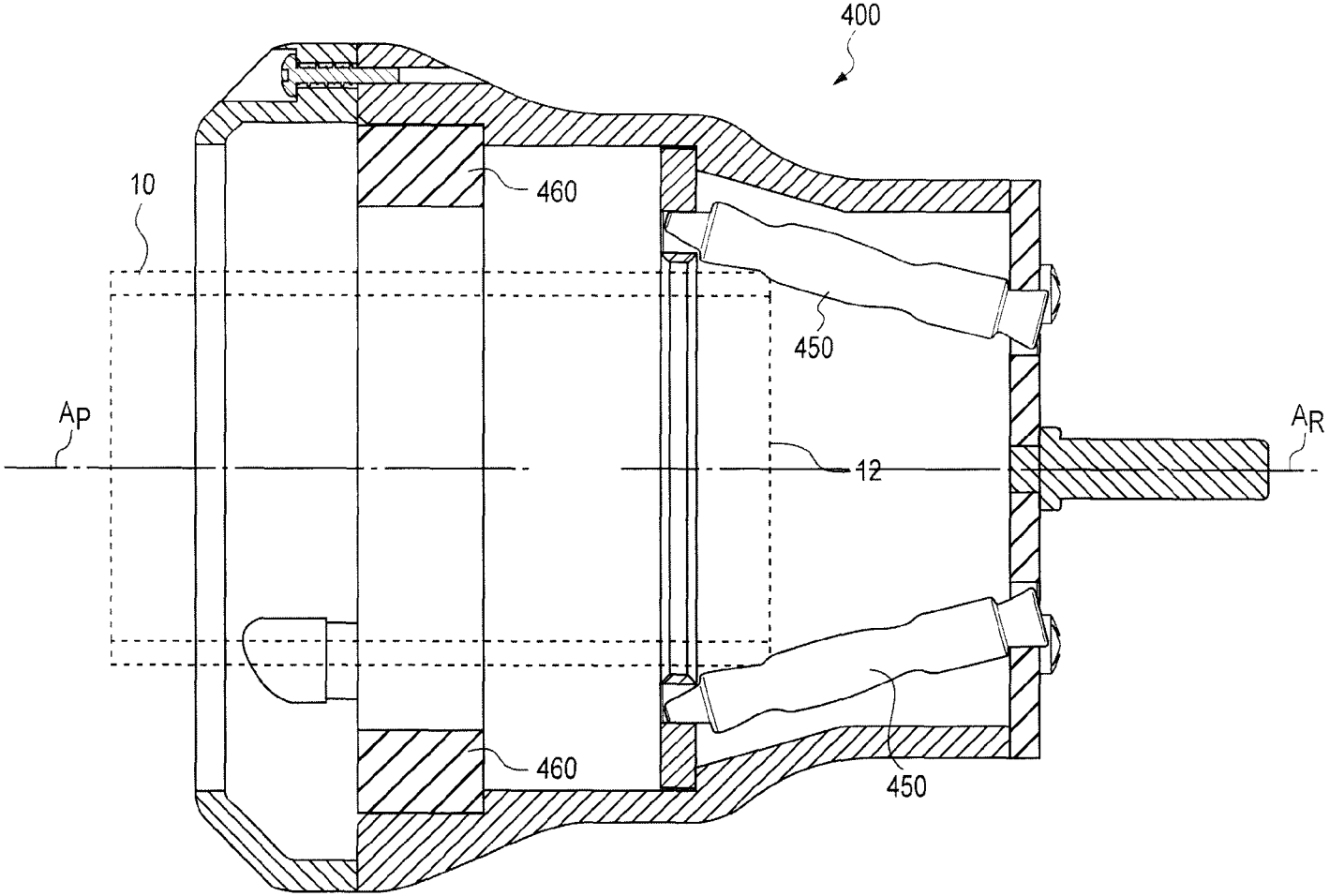
FIG. 22 is a schematic partial cross sectional view of yet another preferred embodiment tool in a deburring operation.

For example, FIG. 22 illustrates another preferred embodiment tool 400 including a plurality of rollers 450 with yet another contoured configuration. The rollers 450 can each be configured to impart an arcuate or curved outer edge along the distal end 12 of a pipe 10 contacted therewith. It will be appreciated that a wide array of configurations can be used for the rollers 450 to produce various configurations for pipe ends. Additional aspects of the tool 400 are as previously described tools 100 and 200.

As noted, many of the tools include an abrasive member incorporated within the hollow interior of the tool housing. For example, the tool 300 comprises an abrasive assembly generally shown in FIG. 21 as 360. And, the tool 400 comprises an abrasive assembly depicted in FIG. 22 as 460. Preferably, the abrasive assembly includes an effective amount of an abrasive material exposed along a face of one or more abrasive member(s), and a scrim backing exposed along an oppositely directed face of the abrasive member. The scrim is releasably engageable with conventional hook material as in hook and loop material combinations. The scrim layer is preferably disposed on a face or face portion of the abrasive member. It will be appreciated that the invention includes other forms of scrim and scrim-like materials, so long as they provide secure retention of the abrasive member to the tool housing, yet also provide releasable engagement between the abrasive member and the housing.

Figure 23:
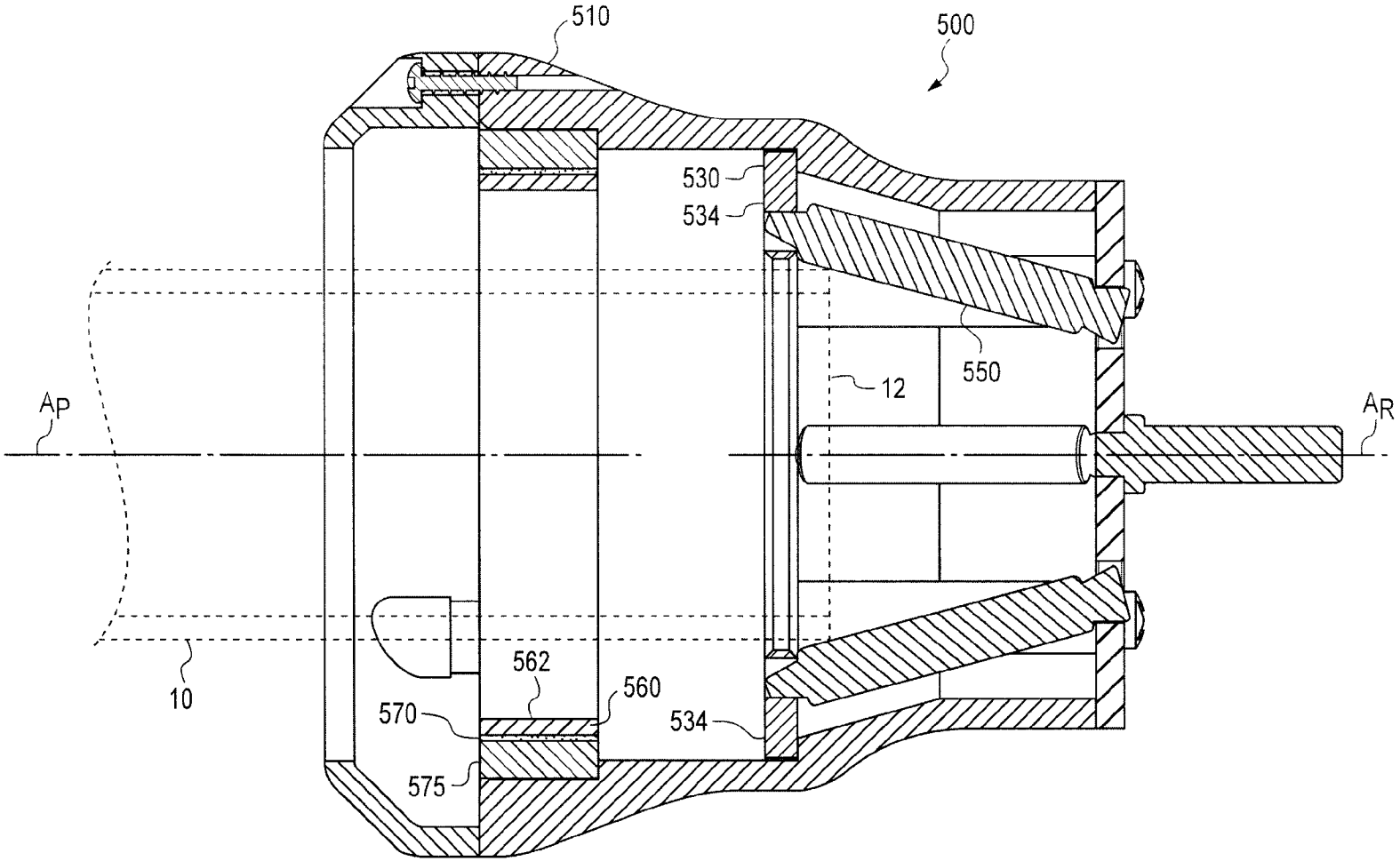
FIG. 23 is a schematic partial cross sectional view of another preferred embodiment tool in accordance with the present invention.

FIG. 23 illustrates yet another preferred embodiment tool 500 having similar components as previously described tools, such as for example a housing 510 and rollers 550. A significant feature of the tool 500 is the provision of a region or layer 575 of a compressible or deformable material which after removal of a load or force resulting in compression or deformation, returns to its original shape or substantially so. As previously noted, this characteristic is referred to herein as the material being "compliant." Examples of such compliant materials and which can be used as layer 575 include various foamed materials. The compliant foam backing provides a significant advantage in that it allows an abrasive member 560 to remain in contact with the pipe along the entire width of the abrasive member even if a small angle is inadvertently introduced between the axis of the pipe and the longitudinal axis and/or axis of rotation of the tool during the pipe coating removal process. As illustrated in FIG. 23, the compliant layer 575 is disposed between the inner face of the housing 510 and the abrasive member 560. Most preferably, a layer or region 570 of a hook and loop member is provided between the abrasive member 560 and the compliant layer 575. The compliant layer 575 can be secured to the inner face of the housing 510 in a variety of different fashions. However, it is preferred that the layer 575 be secured with adhesive.

The tool 500 can also be used to prepare an outer surface region of a pipe for receiving a press fitting, by removing any coatings such as black coatings in a region of interest along the pipe outer surface. For this operation, a pipe 10 is inserted within the general hollow interior of the tool 500 however positioned such that an exposed outer face 562 of the abrasive member 560 contacts a region of the pipe outer surface while the end 12 of the pipe 10 is contacted with a forward face 534 of the front plate 530. In this position, it will be appreciated that the longitudinal axis $A_P$ of the pipe 10 is generally radially spaced from and parallel to the axis of rotation $A_R$ of the tool 500. As previously explained, upon powered rotation of the tool 500, the tool is orbited about the stationary pipe 10, while maintaining contact between the pipe end 12 and the face 534 of the plate 530. This ensures that black coating or other undesirable materials or finishes are removed from the outer surface of the pipe within a circumferential region or band that is appropriately spaced from the pipe end 12 and which has a width sized to accommodate a press fitting.

Figure 24:
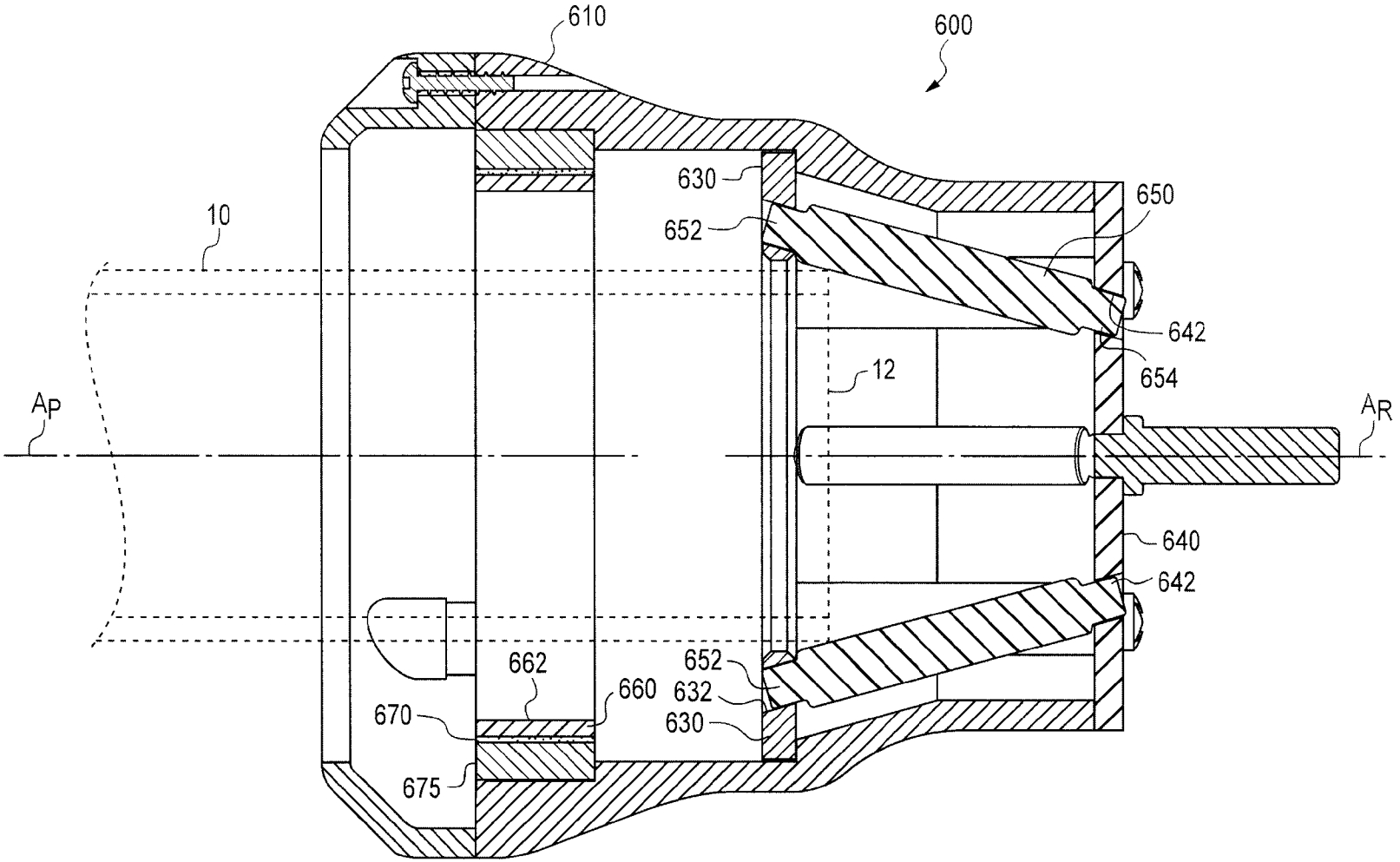
FIG. 24 is a schematic partial cross sectional view of another preferred embodiment tool in accordance with the present invention.

FIG. 24 depicts yet another preferred embodiment tool 600 in accordance with the invention. The tool 600 includes a housing 610, a plurality of rollers 650, a compliant layer 675, an abrasive member 660 disposed thereon, and a layer of a hook and loop material 670 disposed between the abrasive member 660 and the compliant layer 675. The abrasive member 660 defines an exposed inwardly directed abrasive surface 662. A significant feature of the tool 600 is the use of cylindrically shaped end regions 652 and 654 for each of the rollers 650. Thus, instead of using the previously described divergent and convergent end sections such as for rollers 250, i.e. ends 254 and 252, respectively, depicted in FIG. 15, the rollers 650 of the tool 600 use circumferential end regions having a constant radius. In view of this end configuration for the end sections 652, 654 of the rollers 650, and the angled orientation of each of the rollers 650 relative to the axis of rotation of the tool 600, the receiving apertures defined in the front plate 630 and rear plate 640 are angled relative to the plane of orientation of these plates. Thus, specifically, for each roller 650, a receiving aperture 632 is defined in the front plate 630 and a corresponding receiving aperture 642 is defined in the rear plate 640. The aperture 632 is sized and oriented to supportably receive the forward end 652 of the roller 650. And the aperture 642 is sized and oriented to receive the rear end 654 of the roller 650. Each of the apertures 632 and 642 is formed to be aligned with one another and extend at the same angle relative to the tool's axis of rotation. This angle is designated as angle X in FIG. 15. In all embodiments of the tools, it may be preferred to include bearings in each aperture or receiving region that engages a roller end. Examples of such bearings include but are not limited to sleeve bearings or rolling element bearings.

Another preferred embodiment tool includes a housing, an abrasive member disposed therein, a front plate and a rear plate, generally as previously described. The tool does not include rollers, but instead includes a plurality of cutting blades generally extending between the plates, and oriented at an angle relative to the axis of rotation of the tool. Preferably, this angle is the same as angle X described in conjunction with tool 100 in FIG. 15. Preferably, the interior rearward portion of the housing is formed to include a collection of slots or each of which is sized to receive and support a cutting blade slidably disposed therein. The tool is used to perform a deburring operation upon an end of a pipe by inserting the pipe within the hollow interior of the tool. The pipe must be held stationary such as through the use of a pipe vise (not shown) or similar device. The end of the pipe is contacted with the plurality of the cutting blades. The tool is rotated about its shaft whereby the blades remove or reform any burrs extending from the end of the pipe when the tool is pushed axially onto the pipe.

Figure 25:
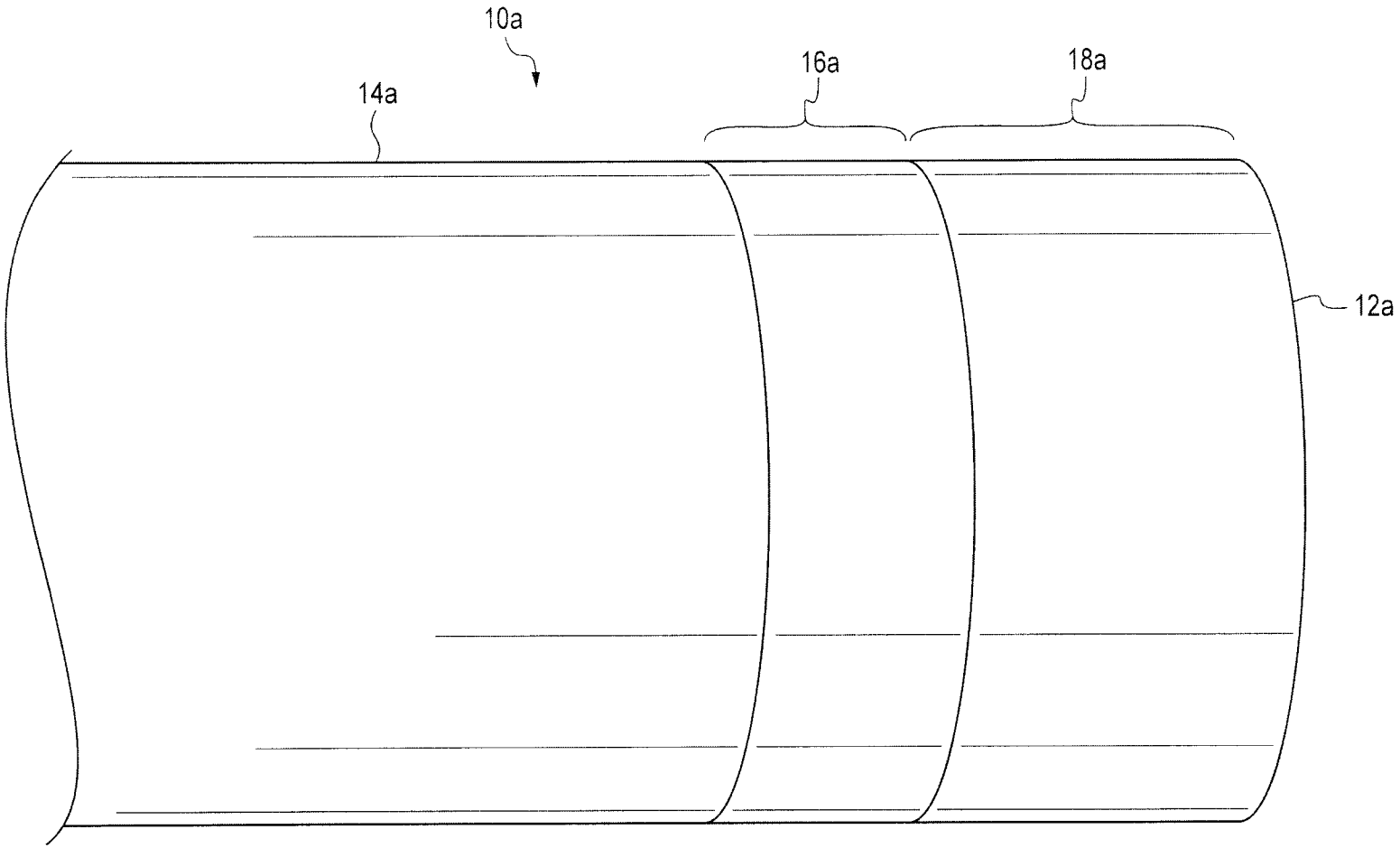
FIG. 25 illustrates an end region of a pipe prepared by use of the preferred tools.

FIG. 25 schematically illustrates a pipe 10*a* after preparation by the various preferred embodiment tools. Specifically, pipe 10*a* defines an outer surface 14*a*, and a distal end 12*a*, respectively. After appropriate use of the tool upon an end region of the pipe 10*a*, a prepared region 16*a* is defined along an outer surface 14*a* of the pipe 10*a* in FIG. 25. The prepared region 16*a* is preferably in the form of a circumferential band extending about the circumference of the pipe 10*a*. In many instances, the prepared region 16*a* is spaced from the distal end 12*a* of the pipe by an unprepared, native region 18*a* as shown in FIG. 25. It will be understood that the present invention tool can be used to form prepared regions such as 16*a* that extend to the distal end 12*a* of the pipe.

As explained in greater detail herein, for many applications in which fittings are to be pressed onto pipe ends, it is preferred that the fitting is located a particular distance from the end of the pipe. This distance typically varies depending upon the size of the pipe, particular application, and may also depend upon the particular type of fitting and fitting manufacturer. Thus, in order to accommodate such fittings, it is necessary that the prepared region along the pipe exterior, for example prepared region 16*a* shown in FIG. 25, be located a certain corresponding distance form the pipe end 12*a*.

In accordance with the present invention, the tool is sized so that the distance between the abrasive member and the front face of the front plate corresponds to the desired distance at which the fitting is to be located from the end of the pipe. Referring to FIG. 25, this distance is the distance between region 16*a* and the pipe end 12*a*. In accordance with the invention, a convenient means to consistently and readily form a prepared region along a pipe that is appropriately spaced from the pipe end, is to contact the end of the pipe to the front face of the front plate. Thus, when using a tool with any of the previously described housings, it is not necessary to measure or otherwise selectively position the tool along a pipe. Instead, all that an operator must do is contact the end of the pipe with the front face of the front plate of the tool. Once in this placement, the abrasive member is appropriately located at the proper location along the pipe and correctly spaced from the pipe end. Thus, in many of the preferred tools described herein, the distance between (i) the abrasive surface and/or the abrasive assembly and (ii) the front plate, is equidistant when measured along a line parallel to the longitudinal axis of the housing.

In certain versions of the tools, the tool housing may be formed so that the distance between the abrasive assembly or the abrasive surface thereof and the front plate is selectively adjustable. Typically, the adjustment provisions are in the form of mechanical assemblies. For example, the housing can include telescoping provisions located between the abrasive assembly and the front plate. Preferably, the adjustment provisions enable the housing to be extended or retracted. This allows adjustment of the distance between abrasive members and components within the interior of the housing such as a front plate and/or a rear plate or faces thereof. A user can then selectively adjust the tool so that the distance between the abrasive surface and the front plate corresponds to the particular requirements for the application and fitting. Specifically, it is contemplated that a user may wish to adjust the distance from the pipe or workpiece end, at which an exposed circumferential region or band is formed, which as will be understood, receives a fitting.

Another consideration in preparing regions along pipe surfaces for receiving one or more fittings is the width of the prepared region. Referring to FIG. 25, this is the width of region 16*a*. The particular width may depend upon one or more factors such as the size of the pipe, application, fitting, fitting type, and fitting supplier. However, for nearly all applications, this dimension is about 0.5 inches±0.0625 inches. Accordingly, it is preferred that the abrasive member have a width corresponding to this dimension, i.e. about 0.5 inches. However, it will be appreciated that the present invention includes widths less than or greater than this value.

The present invention also provides various tools which are primarily for removing outer surface regions of pipes or workpieces and which are not used for removing burrs or other projections from pipe ends. Specifically, in this aspect, another preferred embodiment tool is engaged with a rotary power source, for example a drill, and the resulting system positioned for preparing an end region of a pipe. The tool comprises a housing defining a rear face and an oppositely directed front face. The housing also includes a circumferential wall that defines an outer face and an oppositely directed interior face. The tool further comprises a rearwardly extending shaft. As previously described with regard to the tool, the tool also comprises a rear mounting member, a front mounting member or cover plate, and an abrasive member disposed therebetween and accessible from an interior region of the tool. The abrasive member defines an inner edge for contacting a region of the pipe to be prepared.

In a preferred version of this tool, the rear mounting member is integrally formed with the housing. In addition, a plurality of pins are affixed to the rear mounting member. In addition, the tool comprises a stop plate along a rear wall of the housing. Specifically, the stop plate is affixed to a front face of the rear wall of the housing and serves as a wear surface for contacting a pipe end. The use of the stop plate is particularly desirable when the housing is formed from plastic. The tool contains provisions for pipe coating removal, but no provisions for removing offensive burrs from the pipe end. Thus, the preferred tools do not include the plurality of rollers.

Figure 26:
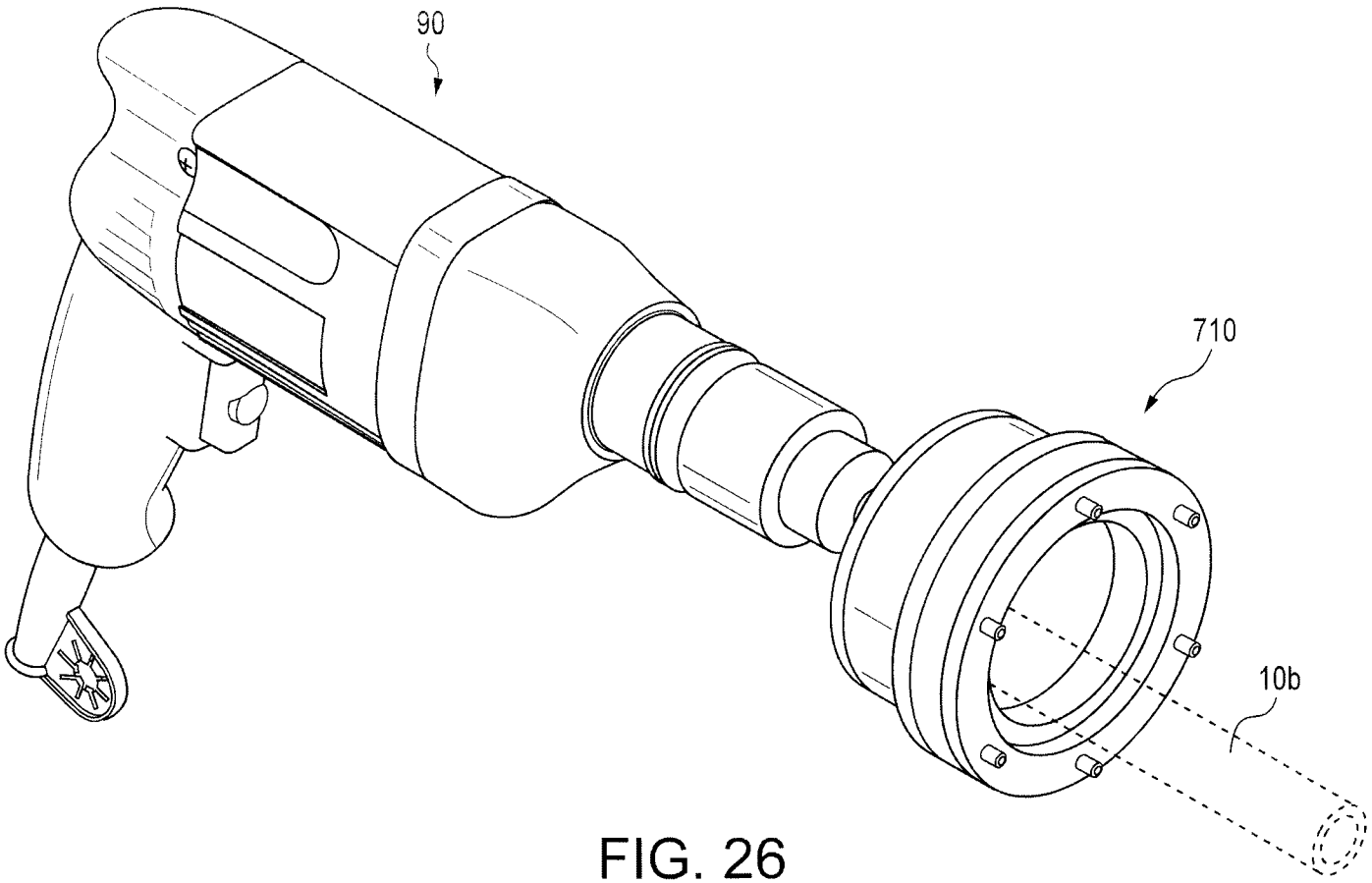
FIG. 26 is a perspective view of another preferred embodiment tool engaged with a hand-held rotary power source, e.g. a drill, during preparation of a pipe end in accordance with the present invention.
Figure 27:
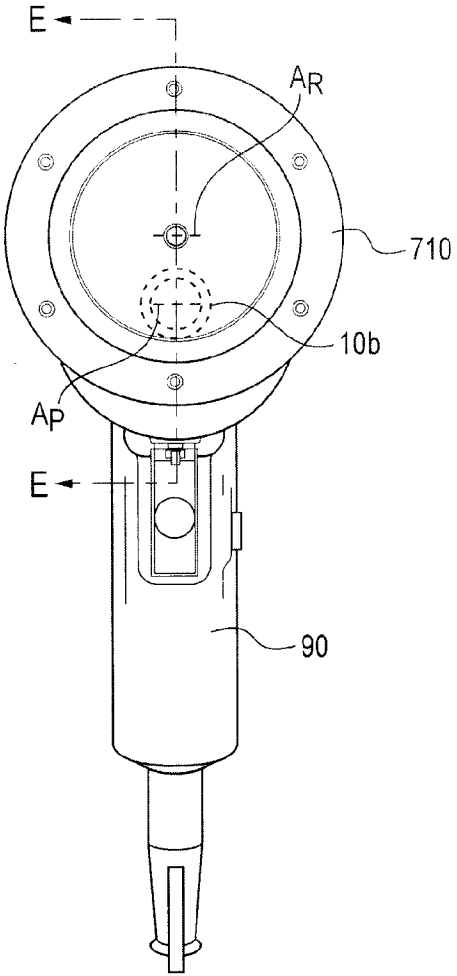
FIG. 27 is a front view of the tool, drill, and pipe end depicted in FIG. 26.
Figure 28:
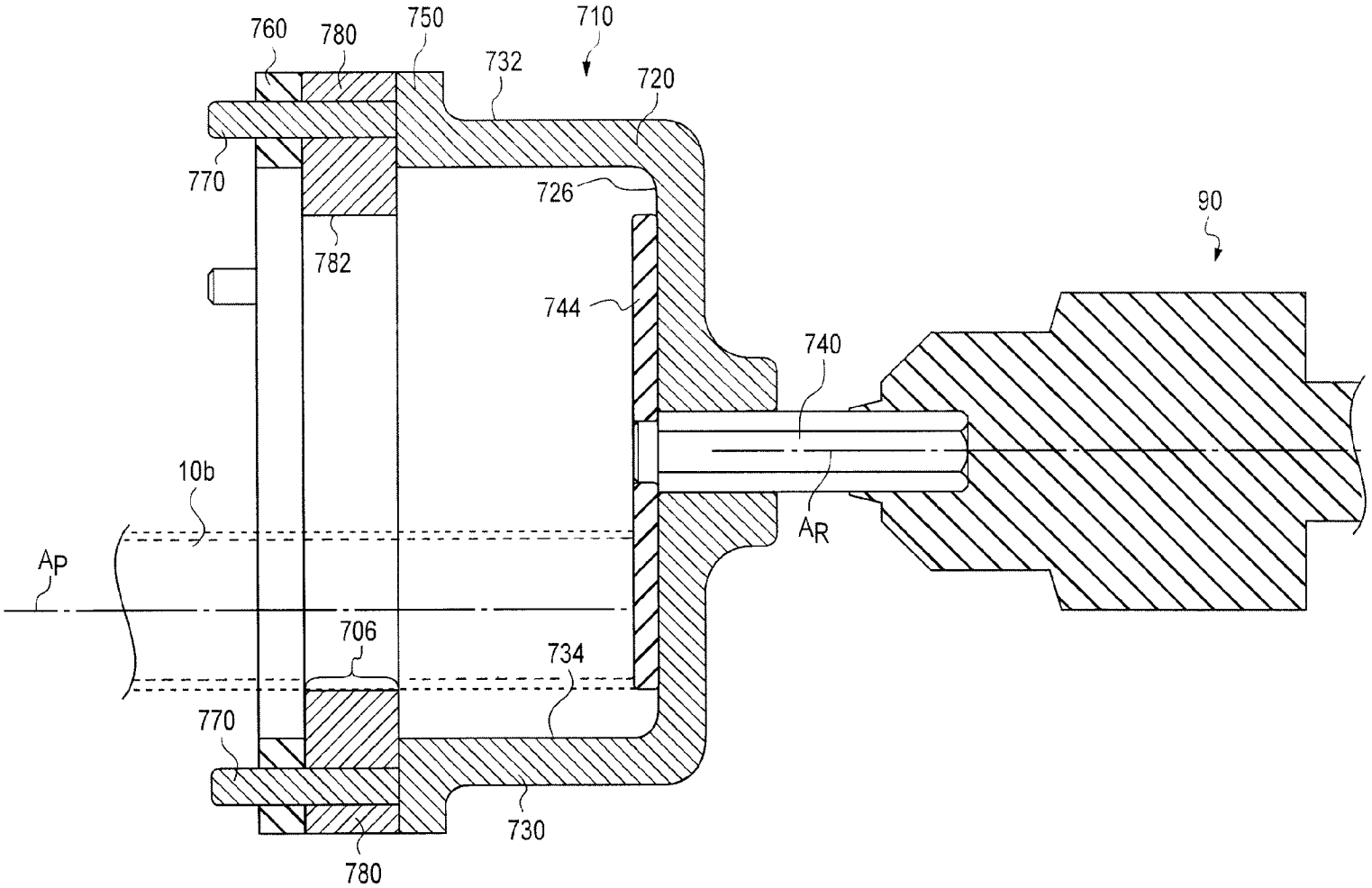
FIG. 28 is a detailed cross sectional schematic view of the tool taken across line E-E in FIG. 27 illustrating its engagement with the drill and positioning relative to the pipe end.

FIGS. 26-28 illustrate an example of such a tool. These figures depict another preferred embodiment tool 710 engaged with a rotary power source, for example drill 90, and the resulting system positioned for preparing an end region of a pipe 10*b*. FIG. 27 is a front view showing the tool 710, drill 90, and pipe 10*b*. FIG. 28 illustrates the tool 710 in greater detail. The tool 710 comprises a housing 720. The housing 720 generally comprises a rearwardly extending shaft 740. The tool 710 also comprises a rear mounting member 750, a front mounting member or cover plate 760, and an abrasive member 780 disposed therebetween. The rear mounting member 750 of the housing 720 includes a circumferential wall 730 that defines an outer face 732 and an oppositely directed interior face 734. The tool 710 further comprises a rearwardly extending shaft 740. The abrasive member 780 defines an inner edge 782 for contacting a region 16*a* of the pipe 10*a* to be prepared for example and as shown in FIG. 25. FIG. 28 illustrates the abrasive member 780 being in the form of a non-woven abrasive material. When using such materials, it is typically not necessary to use a compliant layer as previously described herein.

In this preferred version of the tool 710, the cup-shaped rear mounting member 750 is integrally formed. In addition, a plurality of pins 770 are affixed to the rear mounting member 750 and used to secure the cover plate 760 and the abrasive member 780 thereto. In addition, the tool 710 comprises a stop plate 744 along a rear wall of the housing 720. Specifically, the stop plate 744 is affixed to a front face 726 of the rear wall of the housing 720 and serves as a wear surface for contacting a pipe end. The use of the stop plate is particularly desirable when the housing 720 is formed from plastic.

Figure 29:
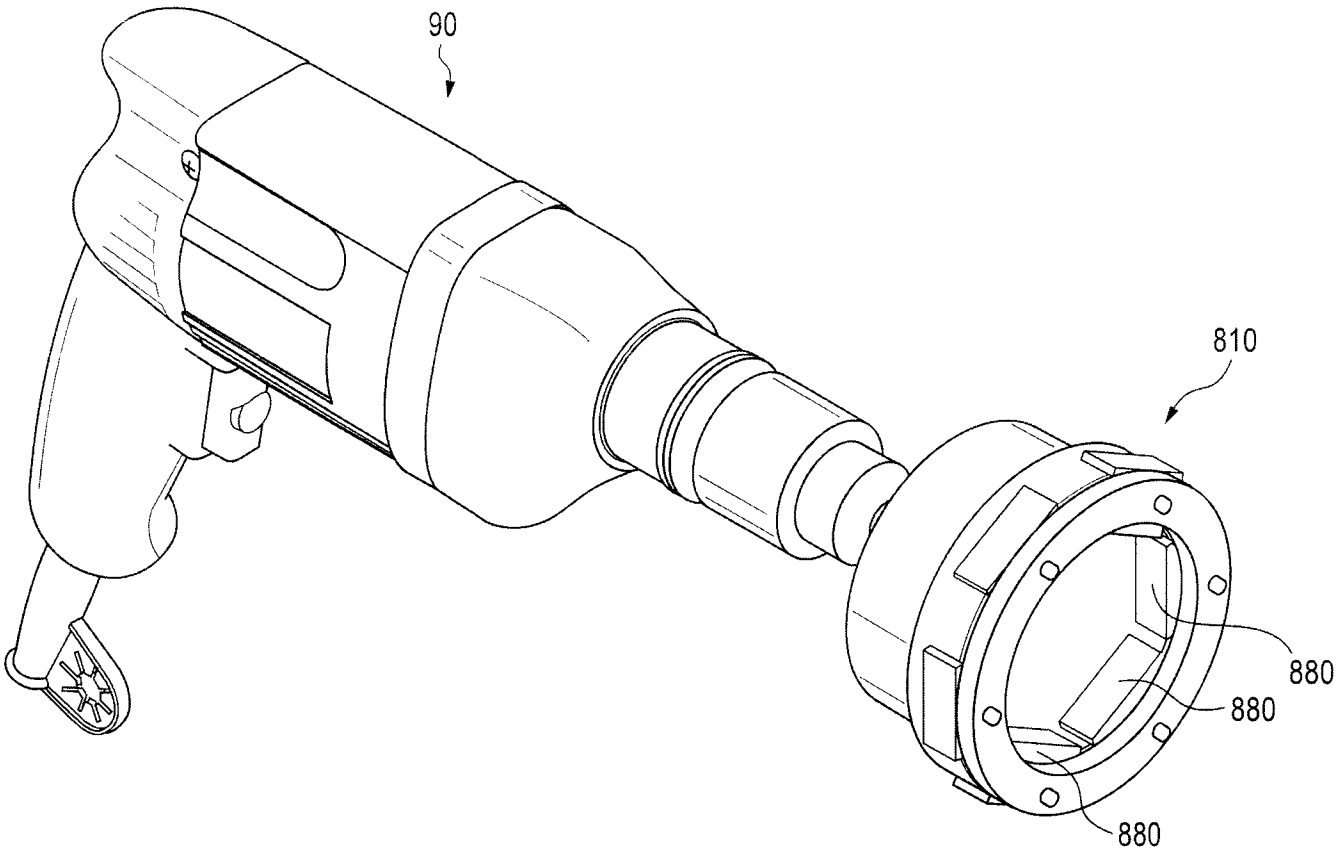
FIG. 29 is a perspective view of another preferred embodiment tool engaged with a hand-held rotary power source such as a drill in accordance with the present invention.
Figure 30:
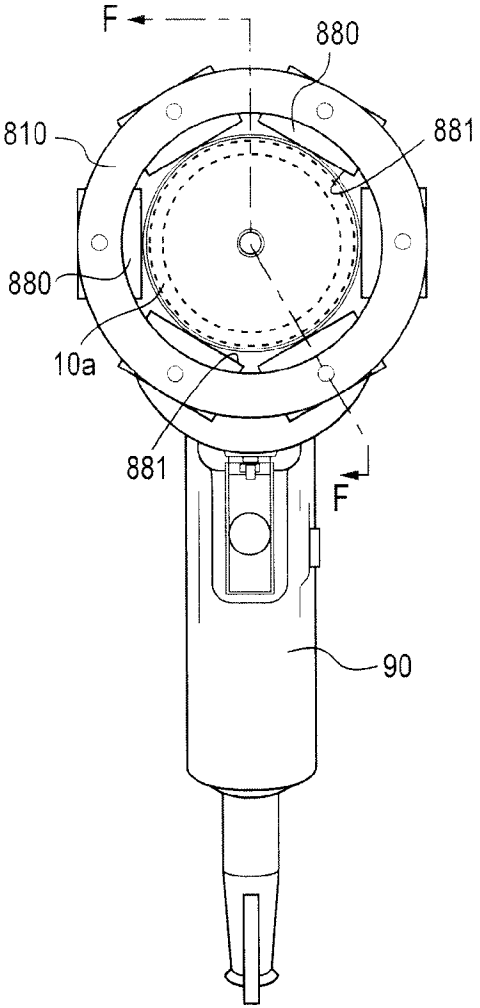
FIG. 30 is a front view of the tool and drill depicted in FIG. 29, shown in combination with a pipe.
Figure 31:
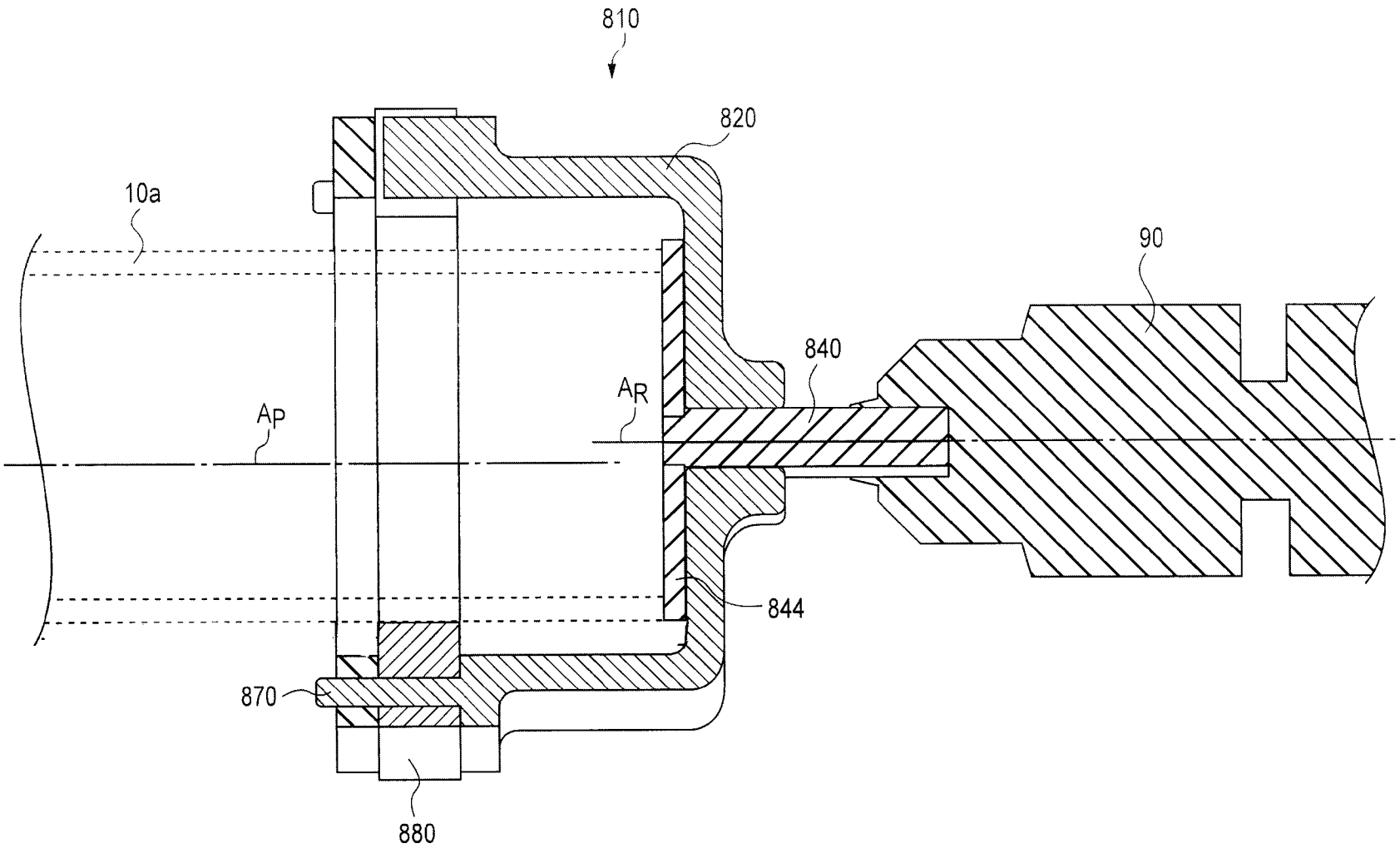
FIG. 31 is a partial cross sectional schematic view of the tool, drill, and pipe taken across line F-F in FIG. 30.

FIGS. 29-31 illustrate another preferred embodiment tool 810 in accordance with the present invention. The tool 810 is used in conjunction with a rotary power source such as drill 90 and is used to prepare a region of pipe 10*a* (see FIGS. 30 and 31), as previously explained. In this embodiment, the tool 810 does not employ a unitary or single abrasive member, such as previously described abrasive members 660, 780 and others. Instead, the tool 810 uses a plurality of abrasive sheets or components 880 spaced about the interior of the tool. Referring to FIGS. 30 and 31, the plurality of abrasive sheets 880 are depicted. FIG. 31 is a schematic cross sectional view of the tool 810 taken across line F-F of FIG. 30. The tool 810 is similar to the previously described tools and includes a housing 820, a shaft 840, a stop plate 844 for contacting an end of the pipe, and pins 870 for engaging the plurality of abrasive members 880.

Each of the abrasive members 880 is preferably in the form of a rectangular or square shaped piece. Each abrasive member 880 defines an abrasive face 881 that is directed toward the interior of the tool 810. The face 881, as will be appreciated, serves to contact a pipe when placed within the tool 810. A characteristic of the abrasive members 880 is that the abrasive face 881 is flat or at least substantially so.

Figure 32:
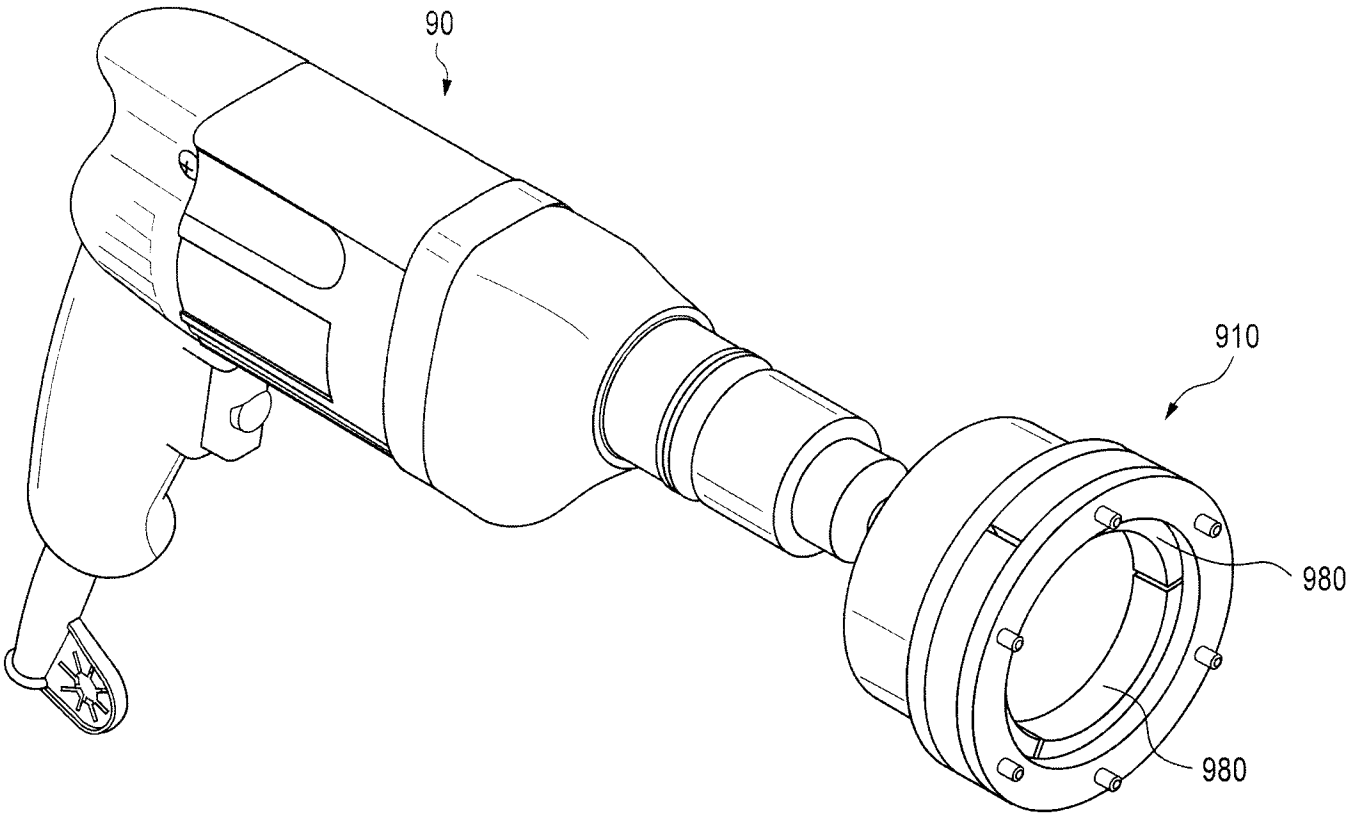
FIG. 32 is a perspective view of another preferred embodiment tool engaged with a hand-held rotary power source such as a drill in accordance with the present invention.
Figure 33:
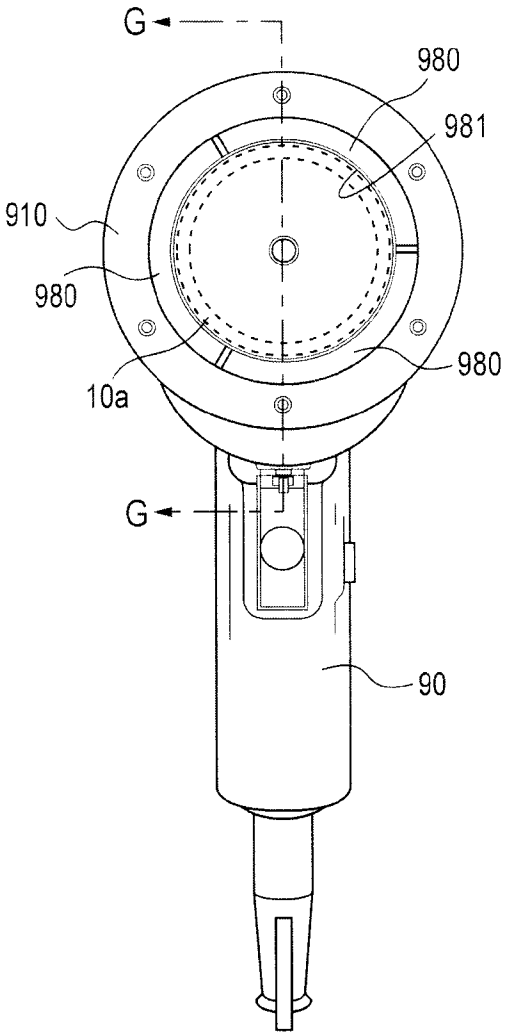
FIG. 33 is a front view of the tool and drill shown in FIG. 32, in combination with a pipe.
Figure 34:
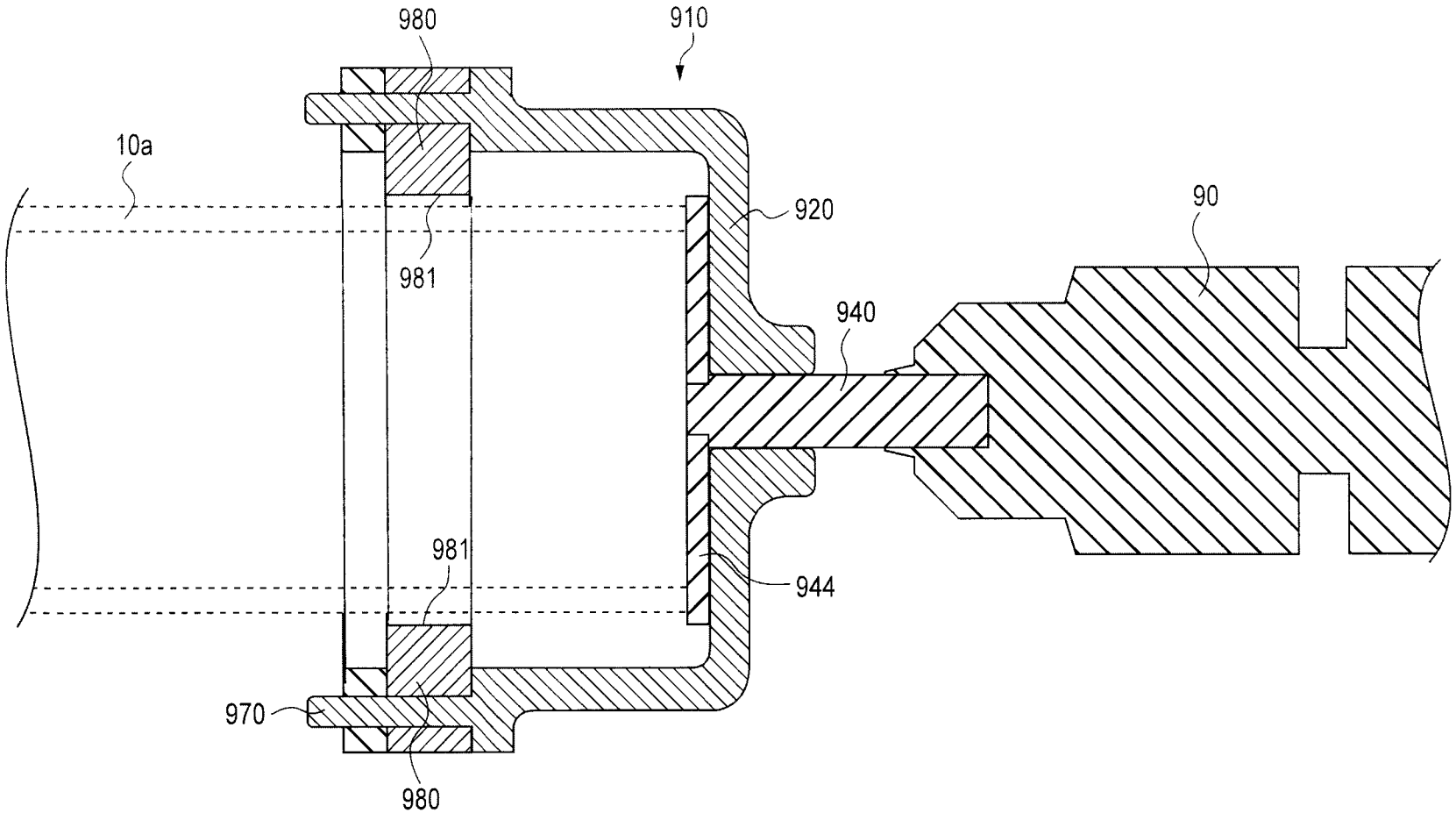
FIG. 34 is a partial cross sectional schematic view of the tool, drill, and pipe taken across line G-G in FIG. 33.

FIGS. 32-34 illustrate another preferred embodiment tool 910 in accordance with the invention. The figures illustrate the tool 910 in conjunction with a drill 90 and pipe 10*a* (see FIGS. 32-34). The tool 910 is similar to the previously described tools, and particularly tool 810. However, instead of utilizing a plurality of abrasive members having flat abrasive faces, the tool 910 uses a plurality of abrasive members 980 defining arcuate abrasive faces 981, and particularly having concave recessed abrasive surfaces. Generally, the tool 910 includes a housing 920, a shaft 940 for engagement to the drill 90, a stop plate 944, and a plurality of pins 970 for retaining abrasive members 980.

Referring to FIGS. 33 and 34, the tool 910 includes a plurality of arcuate abrasive members 980 spaced about and directed toward the interior of the housing 920 of the tool 910. The particular shape of each arcuate abrasive member 980 depends upon the number of members that are arranged about the interior of the housing 920, and possibly upon other factors such as the size of the pipe. However, it is generally preferred to use a total of three (3) members 980, thus each member is shaped to extend about 120°. The concave face of each member 980 serves as the abrasive face 981 for contacting pipe.

Another preferred embodiment tool is generally as previously explained and includes a housing, a shaft, an integrally formed rear mounting member, a front mounting member, one or more pins, and one or more abrasive members. The tool also comprises a reamer attachment that defines a reaming surface. The reamer attachment is preferably disposed within the hollow interior of the housing and preferably in contact with the interior front face of the housing. The reamer attachment defines a conical reaming surface that is sized and oriented to receive a pipe end. The reaming surface includes provisions to remove burrs or other imperfections from a pipe end. Typically, the reaming surface may include a series of spaced ridges and/or serrations, or may utilize an abrasive material. The reamer attachment is preferably engaged to the shaft such that upon rotation of the shaft by the drill, the reamer attachment is also rotated.

It is contemplated that commercially available manual reamers that could be modified or otherwise incorporated in the tool and used as the previously described reamer provisions. It is also contemplated that the diameter of the housing may need to be enlarged so as to accommodate the reamer provisions.

Figure 35:
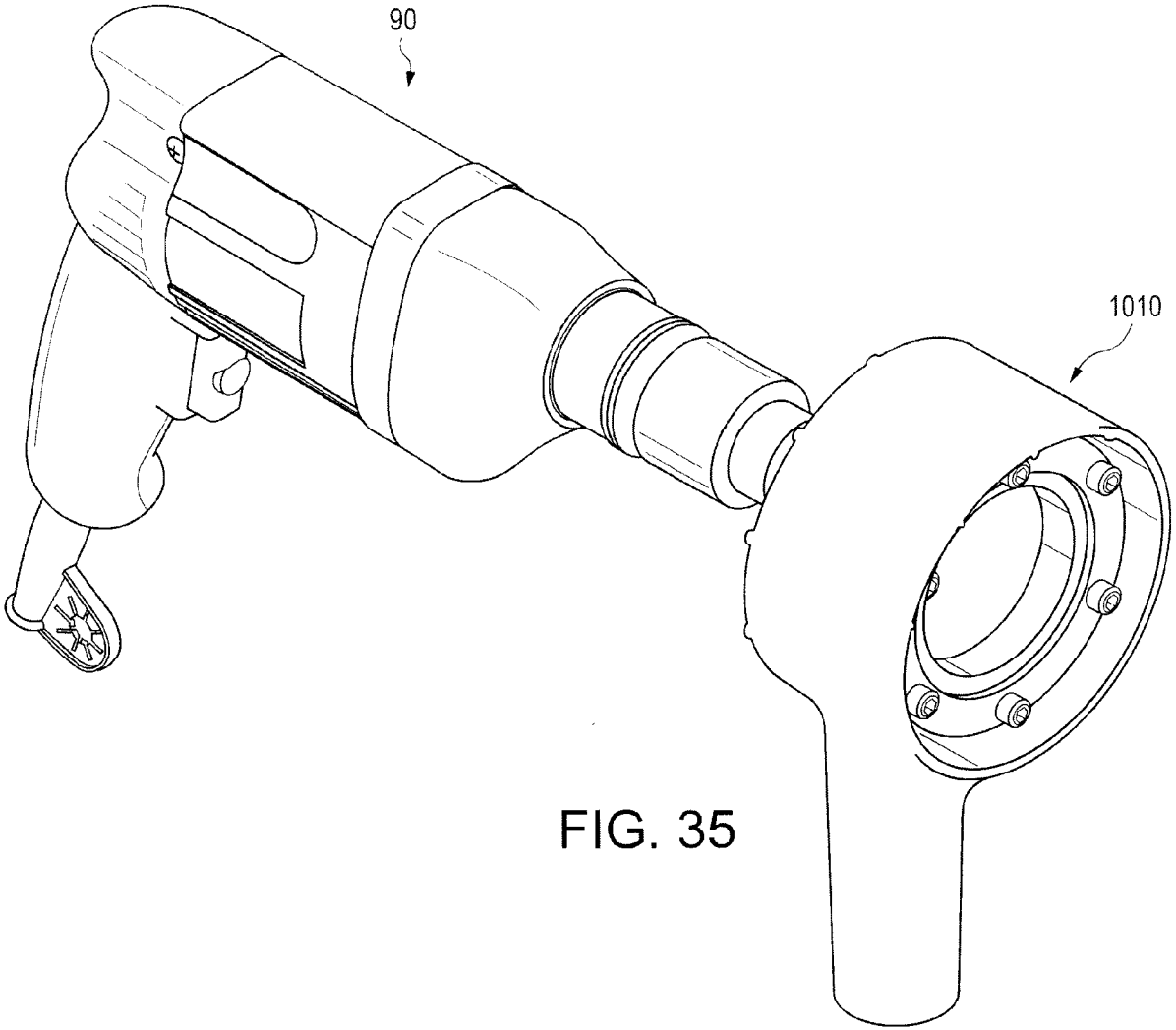
FIG. 35 is a perspective view of another preferred embodiment tool engaged with a hand-held rotary power source such as a drill in accordance with the present invention.
Figure 36:
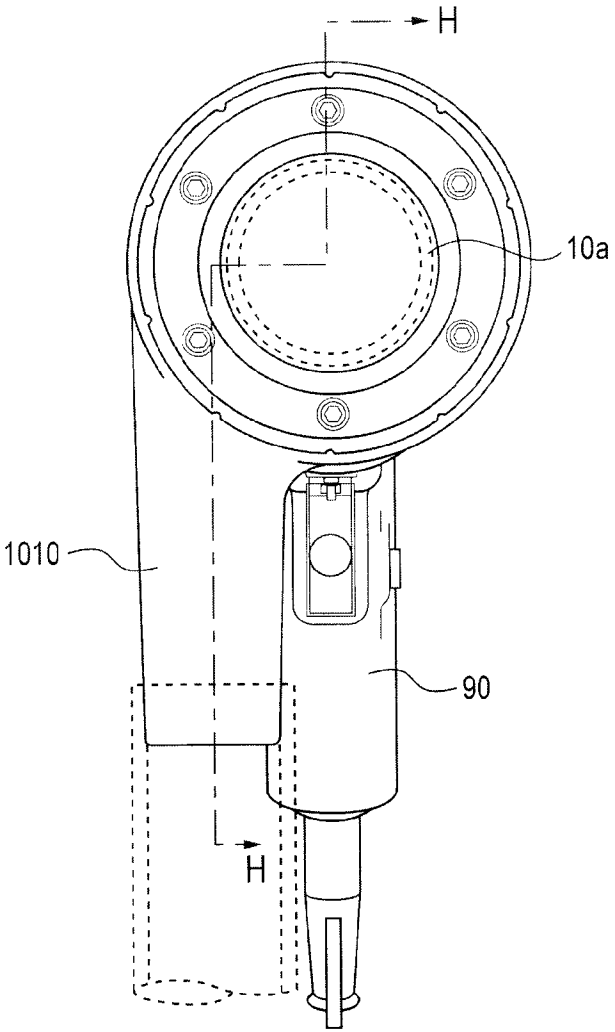
FIG. 36 is a front view of the tool and drill shown in FIG. 35, illustrated in conjunction with a pipe and a vacuum source.
Figure 37:
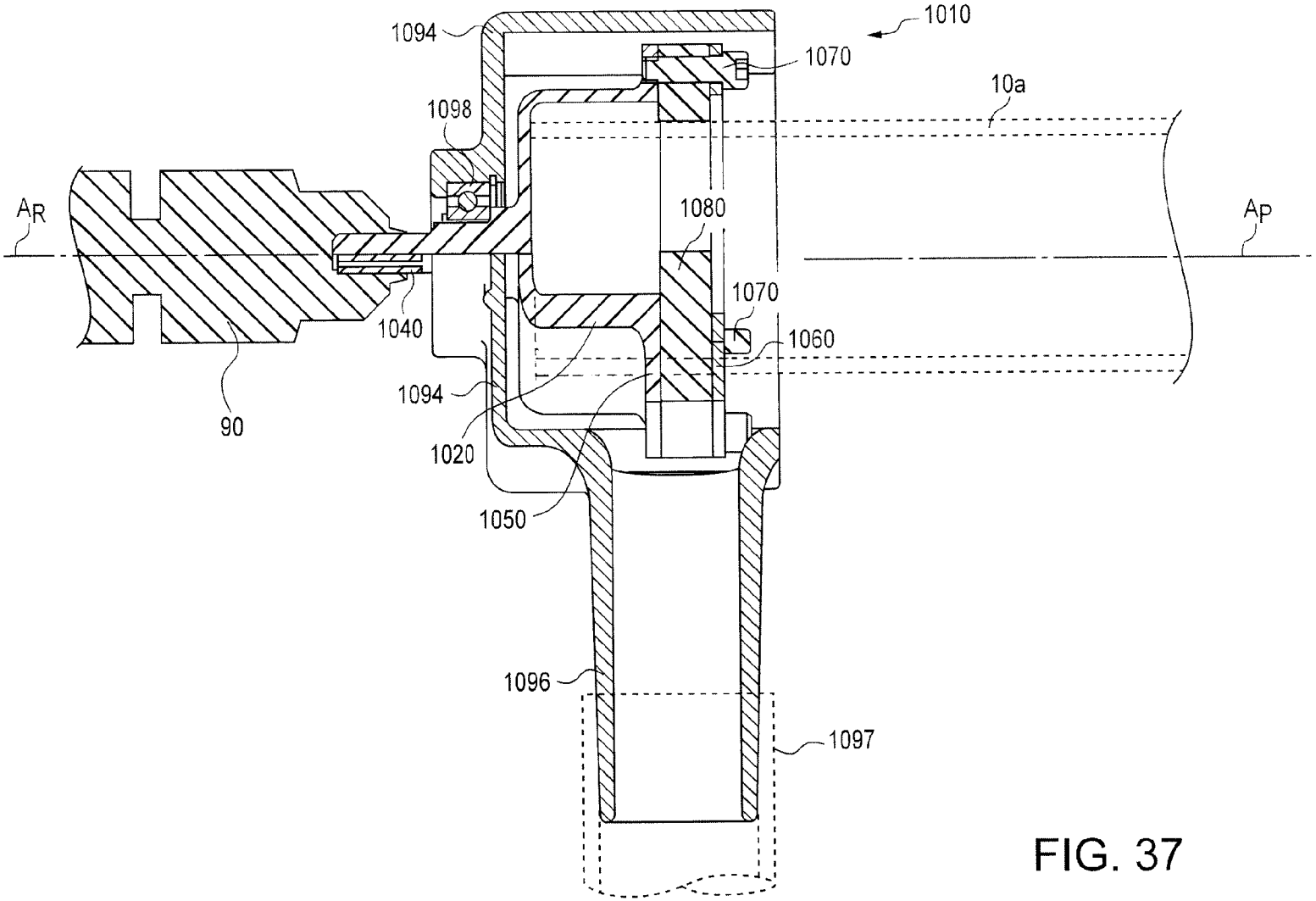
FIG. 37 is a partial cross sectional schematic view of the tool, drill, pipe, and vacuum source taken across line H-H in FIG. 36.

FIGS. 35-37 illustrate yet another preferred embodiment tool in accordance with the invention. The tool 1010 is generally as previously described and is shown in conjunction with a drill 90 and pipe 10*a* (see FIGS. 36 and 37). The tool 1010 includes a housing 1020, a shaft 1040, a rear mounting member 1050, a front mounting member 1060, one or more fasteners 1070, and an abrasive member 1080.

As best illustrated in FIG. 37, the tool 1010 also includes an optional shroud enclosure 1094 that essentially encloses, or substantially so, the tool 1010. The shroud enclosure 1094 includes connection provisions for connection to a vacuum source, vacuum system or other air filtering operation, generally denoted as 1097, such as by use of a shroud connection 1096. The shroud enclosure 1094, upon connection to an air filtering system, is particularly useful for removing air borne particles or other contaminants that may be generated or otherwise released into the environment during a pipe preparation operation. The tool includes one or more bearing assemblies 1098 located about the shaft 1040 such that upon operation of the drill 90 and rotation of the abrasive member 1080, the shroud enclosure 1094 is independent of such rotation and does not rotate. It will be appreciated that the shroud connection 1096 may also serve as a hand hold for an operator.

Any of the previously noted tools can use an optional shroud. The shroud is affixed to a front mounting plate or similar component of the tool along a mounting face of the shroud. The shroud also includes a forwardly extending wall. Preferably, the wall slopes inwardly. Using such an orientation for the wall results in increased collection of particulates and other debris resulting from a pipe preparation operation.

In addition, the shroud preferably includes provisions for connection to a vacuum system or other air filtration operation as previously explained.

In addition to or instead of a shroud enclosure, the various preferred embodiment tools may also utilize particular configurations for the tool housing front face to promote collection and/or retention of dust, debris and other particulates during use of the tool. For example, the tool housing can include one or more housing sections that extend beyond the location of the housing at which is located the abrasive assembly. An example of this configuration is depicted in FIG. 5 in which the housing 110 includes a relatively long circumferential extension projecting generally parallel to the longitudinal axis of the housing from the abrasive assembly toward the distal edge constituting the front face 114 of the housing. Furthermore, the housings may include housing front face configurations in which the housing is conical or pseudo-conical as it extends from the abrasive assembly to a narrowed opening constituting the housing front face. An example of this configuration is shown in FIG. 15 in which the housing 210 includes an inwardly tapering region generally denoted as 214*a*.

However, it is to be understood that in no way is the invention limited to tools with dust capture provisions. For example, the invention also includes housings that are devoid of any extensions or housing portions which would otherwise extend axially or substantially so, from the abrasive assembly. For example, the invention includes tool embodiments in which the abrasive assembly is disposed immediately adjacent to a front face or opening of the tool housing.

The present invention includes versions of all of the previously described tools in which the variant preferred version does not include an abrasive assembly or any abrasive member(s) within the tool interior. Thus, reference may be made to any of the figures noted herein, while accounting for the absence of the abrasive member(s) or abrasive assembly.

A wide array of powered rotary drives may be used for the drill, i.e. the rotary power source. A preferred drill is a pistol-style hand-held, electrically powered, portable drill available under the designation RIDGID® model R5013. The model R5013 features an auxiliary handle assembly that can be removed from the drill. However, it will be appreciated that nearly any type of drill can be used so long as it provides sufficient speed and torque. During operation of the device, for either the coating removal process (i) or deburring process (ii), the tool is preferably rotated at a speed of from about 1500 to about 3000 RPM. However, it will be understood that the invention includes the use of rotational speeds greater than or lesser than these. Higher speeds are generally preferred for material removal operations.

In addition to the previously provided description, the preferred tools are generally used as follows. A pipe or other object to be prepared or otherwise subjected to the abrasive action of the tool is obtained and secured in a mount or other holding assembly. Alternatively, the pipe may be in an installed state, and thus not require a mount or other holding assembly. The end of the pipe to be prepared is positioned such that a user can freely access the end region and move the tool and rotary power source about the end region of the pipe. The tool is engaged with the rotary power source, which as previously noted can be a hand-held electrically powered drill. The end region of the pipe is identified by the user, and the tool appropriately positioned along that region. For regions along an outer surface of the pipe, the end of the pipe is inserted within the interior region of the housing such that the inner face of the abrasive member can be contacted therewith. Furthermore, the distal end of the pipe material is brought in contact with a front face of the front plate which acts as a mechanical stop and thereby positions the abrasive member the appropriate distance from the end of the pipe to be prepared. While in this position, it will be appreciated that the longitudinal axis of the pipe and that of the tool are generally not collinear with one another, and instead are spaced apart and parallel with each other. Once appropriately positioned, the rotary power source is operated to thereby rotate the tool and the exposed edge of the abrasive member against the desired region of the pipe. The tool is then orbited about the pipe so that the entire region of interest extending about the circumference of the pipe is subjected to the abrasive action of the tool. The course exposed surface of the abrasive member removes any coatings on the outer surface of the pipe, thereby preparing the pipe for receiving one or more fittings.

The preferred tools can also be used to perform a deburring operation along the distal end of the pipe. For this operation, the pipe end is inserted into the generally hollow interior of the tool until the pipe end contacts the rollers or the cutting blades located within the tool. In this operation, the longitudinal axis of the pipe and the axis of rotation of the tool are preferably collinear with one another. The tool is rotated such as by a drill engaged with the shaft of the tool, while the tool is axially urged against the pipe end. Tool rotation is continued until the burrs have been sufficiently removed or reformed.

It will be appreciated that either of the abrasive operation or the deburring operation could be performed before or after the other.

It will be understood that one or more features of any of the preferred embodiments described herein can be combined with one or more other features or aspects of the preferred embodiments.

Many other benefits will no doubt become apparent from future application and development of this technology.

All patents, applications, and articles noted herein are hereby incorporated by reference in their entirety.

As described hereinabove, the present invention solves many problems associated with previous type devices. However, it will be appreciated that various changes in the details, materials and arrangements of parts, which have been herein described and illustrated in order to explain the nature of the invention, may be made by those skilled in the art without departing from the principle and scope of the invention.

What is claimed is:

1. A workpiece end preparation tool comprising:

a housing having a front face, a rear plate, and a sidewall extending therebetween, the housing defining a generally hollow interior accessible from a workpiece opening defined in the front face;

a front plate disposed within the hollow interior of the housing, the front plate affixed to the housing, the front plate defining a forward face, an oppositely directed rear face, and a centrally disposed aperture extending between the forward and the rear faces;

an abrasive assembly disposed within the hollow interior of the housing and releasably affixed thereto, the abrasive assembly defining at least one abrasive surface exposed within the hollow interior of the housing; and a plurality of rollers disposed within the hollow interior of the housing, each roller mounted with the housing and oriented at an angle of from about 10° to about 30° with respect to a longitudinal axis of the housing.

2. The workpiece end preparation tool of claim 1 wherein the abrasive assembly includes an abrasive member having a first face and a differently directed second face, the first face including provisions for releasably affixing the abrasive member to the housing, and the second face providing the at least one abrasive surface.

3. The workpiece end preparation tool of claim 1 wherein the abrasive assembly includes a compliant layer disposed between the abrasive surface and the hollow interior of the housing.

4. The workpiece end preparation tool of claim 3 wherein the compliant layer includes a foamed polymeric material.

5. The work piece end preparation tool of claim 1 wherein the abrasive assembly includes a non-woven abrasive material.

6. The workpiece end preparation tool of claim 1 wherein the abrasive assembly includes an abrasive member having abrasive particulates.

7. The workpiece end preparation tool of claim 1 wherein the plurality of rollers number from 2 to 6 rollers.

8. The workpiece end preparation tool of claim 1 wherein each of the rollers is oriented at an angle of about 15°.

9. The workpiece end preparation tool of claim 1, wherein the housing includes a shaft extending from the rear plate of the housing, the shaft adapted for engagement with a hand-held drill.

10. The workpiece end preparation tool of claim 1 wherein the sidewall of the housing defines a circumferential inner face defining at least in part, the hollow interior of the housing, the abrasive surface extending along the circumferential inner face and directed toward the longitudinal axis of the housing.

11. The workpiece end preparation tool of claim 10 wherein the abrasive surface defines an internal span within the hollow interior of the housing, the internal span extending from a first location on the abrasive surface to a second location on the abrasive surface directly across from the first location, the internal span being greater than a maximum span of the centrally disposed aperture defined by the front plate.

12. The workpiece end preparation tool of claim 1 wherein the abrasive surface is equidistantly spaced from the front plate, when measured along a line parallel to the longitudinal axis of the housing.

13. The workpiece end preparation tool of claim 12 wherein a distance between the front plate and the abrasive surface is adjustable.

14. The workpiece end preparation tool of claim 13 wherein the distance is adjustable by the housing including telescoping provisions located between the front plate and the abrasive assembly.

15. The workpiece end preparation tool of claim 1 wherein the abrasive assembly includes a plurality of abrasive members, each abrasive member releasably affixed to the hollow interior of the housing, and each abrasive member providing an abrasive surface directed toward the longitudinal axis of the housing.

16. The workpiece end preparation tool of claim 15, wherein each abrasive surface is planar.

17. The workpiece end preparation tool of claim 15, wherein each abrasive surface is arcuate.

18. The workpiece end preparation tool of claim 1 wherein the abrasive assembly is positioned along an inner face of the sidewall of the housing and disposed between the front face of the housing and the front plate.

19. The workpiece end preparation tool of claim 1 wherein the tool further comprises:

containment provisions associated with the housing to promote collection and retainment of at least one of dust, particulates, and debris during use of the tool.

20. The workpiece end preparation tool of claim 19 wherein the containment provisions include a shroud enclosure.

21. The workpiece end preparation tool of claim 19 wherein the containment provisions include a housing section that extends beyond a location at which is located the abrasive assembly.

22. The workpiece end preparation tool of claim 21 wherein the housing section is a circumferential section and extends axially beyond the abrasive assembly.

23. The workpiece end preparation tool of claim 21 wherein the housing section is a conical section and extends radially inward from the housing at a location proximate the abrasive assembly.

24. A workpiece end preparation tool comprising:

a generally cylindrical housing defining a longitudinal axis, an open front face, a rear wall, and a circumferential wall extending therebetween, the circumferential wall defining an inner circumferential face, the inner circumferential face and the rear wall collectively defining a hollow interior accessible from the open front face;

an abrasive assembly disposed within the hollow interior of the housing, the abrasive assembly including an abrasive member and a flexible and compliant member, the abrasive member extending along the inner circumferential face of the circumferential wall, and equidistantly spaced from the rear wall, the abrasive member including abrasive particulates dispersed in a substrate secured to a scrim backing, the flexible and compliant member disposed between the abrasive member and the circumferential wall of the housing, the flexible and compliant member including a foamed polymeric material; and a shaft extending rearwardly from the rear wall of the housing, the shaft extending collinearly with the longitudinal axis of the housing.

25. A workpiece end preparation tool comprising:

a housing having a front face, a rear plate, and a sidewall extending therebetween, the housing defining a generally hollow interior accessible from a workpiece opening defined in the front face;

a front plate disposed within the hollow interior of the housing, the front plate affixed to the housing, the front plate defining a forward face, an oppositely directed rear face, and a centrally disposed aperture extending between the forward and the rear faces; and a plurality of rollers disposed within the hollow interior of the housing, each roller mounted with the housing and oriented at an angle of from about 10° to about 30° with respect to a longitudinal axis of the housing, each roller having an end with converging side walls and another end with diverging side walls.

26. The workpiece end preparation tool of claim 25 wherein the plurality of rollers number from 2 to 6 rollers.

27. The workpiece end preparation tool of claim 25 wherein each of the rollers is oriented at an angle of about 15°.

28. The workpiece end preparation tool of claim 25, wherein the housing includes a shaft extending from the rear plate of the housing, the shaft adapted for engagement with a hand-held drill.

29. A method for preparing a workpiece end, the method comprising:

providing a tool including a housing comprising a rear wall, a front face, and a side wall extending therebetween, the housing defining a generally hollow interior accessible from a workpiece opening defined in the front face of the housing, a front plate disposed within the housing between the rear wall and the front face, the front plate defining a forward face and a centrally disposed aperture, an abrasive assembly disposed within the housing, and a plurality of rollers disposed within the housing between the rear wall and the front plate, each roller mounted within the housing and oriented at an angle of from about 10° to about 30° with respect to a longitudinal axis of the housing;

inserting an end of a workpiece to be prepared in the hollow interior of the tool; and displacing at least one of the tool and the workpiece while contacting the workpiece with the tool, to thereby modify the workpiece end.

30. The method of claim 29 wherein the housing includes provisions for extending or retracting the housing to thereby adjust the distance between the abrasive assembly and the front plate, the method further comprising:

extending or retracting the housing such that the distance between the abrasive assembly and the front plate corresponds to a desired distance from the workpiece end.

31. The method of claim 29 wherein the workpiece is a pipe and the method is for preparing the workpiece end to receive a fitting about a circumferential region of the pipe, the method further comprising:

contacting the pipe end with the forward face of the front plate while also contacting the circumferential region of the pipe with the abrasive assembly.

32. The method of claim 31 wherein the displacing operation is performed by rotating the tool.

33. The method of claim 32 wherein the tool is rotated about a longitudinal axis of the tool.

34. The method of claim 32 wherein the tool is orbited about the pipe.

* * * * *